US005352563A

United States Patent [19]

Kawasaki et al.

[11] Patent Number: 5,352,563

[45] Date of Patent: Oct. 4, 1994

[54] BLACK-AND-WHITE SILVER HALIDE PHOTOGRAPHIC LIGHT-SENSITIVE MATERIAL AND A METHOD FOR PROCESSING THE SAME

[75] Inventors: Satomi Kawasaki; Shyouji Nishio; Hideki Komatsu, all of Hino, Japan

[73] Assignee: Konica Corporation, Tokyo, Japan

[21] Appl. No.: 5,657

[22] Filed: Jan. 19, 1993

[30] Foreign Application Priority Data

Jan. 21, 1992 [JP] Japan ..... 4-008685
Jul. 9, 1992 [JP] Japan ..... 4-182623

[51] Int. Cl.[5] ..... G03C 1/06

[52] U.S. Cl. ..... 430/264; 430/598; 430/614; 430/613; 430/628; 430/630; 430/639; 430/640

[58] Field of Search ..... 430/264, 598, 614, 613, 430/628, 630, 639, 640

[56] References Cited

U.S. PATENT DOCUMENTS 5,004,669 4/1991 Yamada et al. ..... 430/264
5,147,756 9/1992 Fodor ..... 430/264
5,198,330 3/1993 Martic et al. ..... 430/538
5,206,123 4/1993 Ooms et al. ..... 430/264
5,217,842 6/1993 Kojima et al. ..... 430/264

FOREIGN PATENT DOCUMENTS 0181728 5/1986 European Pat. Off. .
0508389 10/1992 European Pat. Off. .

*Primary Examiner*—Thomas R. Neville
*Attorney, Agent, or Firm*—Frishauf, Holtz, Goodman & Woodward

[57] ABSTRACT

A silver halide photographic light-sensitive material is disclosed, which comprises a support and provided thereon, a silver halide photographic emulsion layer and a protective layer in that order, wherein at least one layer of said emulsion layer and said protective layer contains a cyclodextrin compound and said emulsion layer contains a hydrazine derivative or a compound represented by the following formula (T):

formula (T)

15 Claims, No Drawings

BLACK-AND-WHITE SILVER HALIDE PHOTOGRAPHIC LIGHT-SENSITIVE MATERIAL AND A METHOD FOR PROCESSING THE SAME

FIELD OF THE INVENTION

The present invention relates to a black-and-white silver halide photographic light-sensitive material and a method for processing the same, and more particularly to a black-and-white silver halide photographic light-sensitive material capable of forming a high-contrast image when processed in a well-preservable developer solution and to a processing method therefor.

BACKGROUND OF THE INVENTION

The photomechanical process includes a step of transforming a continuous-gradation original image into a halftone-dot image. In the process there has hitherto been applied a super-high-contrast image producing photographic technique that employs an infectious development.

The emulsion of a lithographic silver halide light-sensitive material for use in the infectious development is a high-silver-chloride-content (at least 50 mol %) silver chlorobromide emulsion comprising uniformly shaped silver halide grains having an average grain size of about 0.2 μm with a narrow grain size distribution. The lithographic silver halide light-sensitive material of this type, when processed in an alkaline hydroquinone developer solution having a low sulfate ion concentration, i.e., a lith-type developer solution, can provide an image having a high contrast, a high sharpness and a high resolution. The lith-type developer solution, however, is unpreservable because it is subject to degradation by oxidation, so it is difficult to keep its developability constant when used continuously.

On the other hand, there is known a method capable of rapidly forming a high-contrast image without using such an unpreservable lith-type developer solution; for example, a method in which a tetrazolium salt or a hydrazine derivative is added to the light-sensitive material. According to this technique, contrasty images can be obtained even by using a well preservable developer solution for rapid processing.

However, the printing industry seeks better-quality printed matter producing techniques, since there is a strong demand for better-finished photographic image quality, particularly having still more improved image sharpness than ever before.

The hydrazine-derivative-containing silver halide photographic light-sensitive material has a problem of its own that after being processed, sandy fine black spots, so-called pepper fog occurs on its unexposed area. However, no drastic measures for solving this problem have yet been found to date.

Where a tetrazolium salt is used to harden the light-sensitive material, a developer solution for use in processing the light-sensitive material must contain a development restrainer, but the development restrainer is so hardly soluble in water that it requires the use of a large amount of an organic solvent, which causes an environmental problem at the time of processing and waste developer disposal problem.

SUMMARY OF THE INVENTION

The present invention has been made for resolving the above-mentioned problems. Accordingly, in a method for processing a tetrazolium salt or hydrazine derivative-containing silver halide photographic light-sensitive material and processing chemicals used therefor, one object of the present invention is to provide a processing method which is capable of forming a photographic image having an excellent sharpness;

another object of the invention is to provide a method for processing a silver halide photographic light-sensitive material which is improved with respect to its environmental problem at the time of processing as well as to its waste developer disposal problem; and a further object of the invention is to provide a technique for processing the hydrazine derivative-containing silver halide photographic light-sensitive material so as to be free of black spots with time.

The above objects of the invention are accomplished by the following (1), (2) and (3):

(1) In a method for processing a black-and-white silver halide photographic light-sensitive material comprising a support having thereon at least one silver halide emulsion layer, the black-and-white silver halide photographic light-sensitive material processing method comprising developing the silver halide emulsion layer containing a compound represented by the following Formula T or a hydrazine derivative in the presence of a cyclodextrin compound;

Formula T

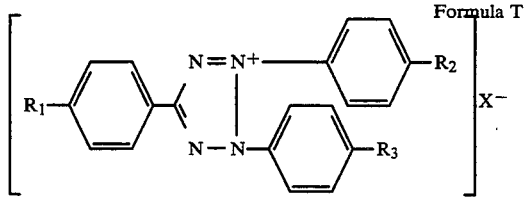

wherein $R_1$, $R_2$ and $R_3$ each represent a hydrogen atom or a substituent, and $X^-$ is an anion.

(2) In a black-and-white silver halide photographic light-sensitive material comprising a support having thereon at least one silver halide emulsion layer, the black-and-white silver halide photographic light-sensitive material, in which the silver halide emulsion layer contains a compound represented by the above Formula T or a hydrazine derivative and the silver halide emulsion layer and/or the protective layer thereof contain a cyclodextrin compound. (3) In a method for processing a black-and-white silver halide photographic light-sensitive material comprising a support having thereon at least one silver halide emulsion layer, the black-and-white silver halide photographic light-sensitive material processing method comprising processing the black-and-white silver halide light-sensitive material containing a compound represented by the above Formula T in its silver halide emulsion layer in a developer solution containing a cyclodextrin compound.

DETAILED DESCRIPTION OF THE INVENTION

Firstly, compounds represented by Formula T are explained.

In Formula T, preferred examples of the substituent represented by $R_1$, $R_2$ or $R_3$ include alkyl groups such as methyl, ethyl, cyclopropyl, propyl, isopropyl, cyclobutyl, butyl, isobutyl, pentyl, cyclohexyl; amino group; acylamino groups such as acetylamino; hydroxyl group; alkoxy groups such as methoxy, ethoxy, propoxy, butoxy, pentoxy; acyloxy groups such as acetyloxy; halogen atoms such as flourine, chlorine, bromine; carbamoyl groups; acylthio groups such as acetylthio; alkoxycarbonyl groups such as ethoxycarbonyl; carboxyl group; acyl groups such as acetyl; cyano group, nitro group, mercapto group, sulfoxy group and aminosulfoxy group. Examples of the anion represented by $X^-$ include halogen ions such as chloride ion, bromide ion, iodide ion; inorganic acid radicals such as of nitric acid, sulfuric acid, perchloric aicd; organic acid radicals such as of sulfonic acid, carboxylic acid; anionic active agents, e.g., lower alkylbenzene-sulfonate anion such as p-toluene-sulfonate anion, higher alkylbenzene-sulfonate anion such as p-dodecyalbenzenesulfonate anion, higher alkyl sulfate anion such as lauryl sulfate anion, boric acid-type anion such as tetraphenyl boron, dialkylsulfo-succinate anion such as di-2-ethylhexylsulfosuccinate anion, polyether-alcohol-sulfate anion such as cetyl-polyethenoxy-sulfate anion, higher fatty acid anion such as stearic acid anion, and polymers with acid radicals such as polyacrylic acid anion.

Examples of the compound represented by Formula T are listed in Table T.

TABLE T

| Compound No. | $R_1$ | $R_2$ | $R_3$ | $X^-$ |
|---|---|---|---|---|
| T-1 | H | H | H | $Cl^-$ |
| T-2 | H | p-$CH_3$ | p-$CH_3$ | $Cl^-$ |
| T-3 | H | m-$CH_3$ | m-$CH_3$ | $Cl^-$ |
| T-4 | H | o-$CH_3$ | o-$CH_3$ | $Cl^-$ |
| T-5 | p-$CH_3$ | p-$CH_3$ | p-$CH_3$ | $Cl^-$ |
| T-6 | H | p-$OCH_3$ | p-$OCH_3$ | $Cl^-$ |
| T-7 | H | m-$OCH_3$ | m-$OCH_3$ | $Cl^-$ |
| T-8 | H | o-$OCH_3$ | o-$OCH_3$ | $Cl^-$ |
| T-9 | p-$OCH_3$ | p-$OCH_3$ | p-$OCH_3$ | $Cl^-$ |
| T-10 | H | p-$C_2H_5$ | p-$C_2H_5$ | $Cl^-$ |
| T-11 | H | m-$C_2H_5$ | m-$C_2H_5$ | $Cl^-$ |
| T-12 | H | p-$C_3H_7$ | p-$C_3H_7$ | $Cl^-$ |
| T-13 | H | p-$OC_2H_5$ | p-$OC_2H_5$ | $Cl^-$ |
| T-14 | H | p-$OCH_3$ | p-$OCH_3$ | $Cl^-$ |
| T-15 | H | p-$OCH_3$ | p-$OC_2H_5$ | $Cl^-$ |
| T-16 | H | p-$OC_5H_{11}$ | p-$OCH_3$ | $Cl^-$ |
| T-17 | H | p-$OC_8H_{17}$-n | p-$OC_8H_{17}$-n | $Cl^-$ |
| T-18 | H | p-$C_{12}H_{25}$-n | p-$C_{12}H_{25}$-n | $Cl^-$ |
| T-19 | H | p-$N(CH_3)_2$ | p-$N(CH_3)_2$ | $Cl^-$ |
| T-20 | H | p-$NH_2$ | p-$NH_2$ | $Cl^-$ |
| T-21 | H | p-OH | p-OH | $Cl^-$ |
| T-22 | H | m-OH | m-OH | $Cl^-$ |
| T-23 | H | p-Cl | p-Cl | $Cl^-$ |
| T-24 | H | m-Cl | m-Cl | $Cl^-$ |
| T-25 | p-CN | p-$CH_3$ | p-$CH_3$ | $Cl^-$ |
| T-26 | p-SH | p-$OCH_3$ | p-$OCH_3$ | $Cl^-$ |
| T-27 | H | p-$OCH_3$ | p-$OCH_3$ | 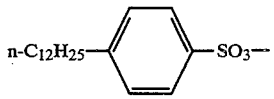 |

The tetrazolium compound represented by Formula T can be synthesized by a known method. For example, coupling reaction of a diazonium salt with a hydrazine compound is made to form a diazohydrazine, which then reacts with an aldehyde to obtain a formazan. The formazan is then oxidized, whereby an objective tetrazolium compound can be obtained. For the synthesis reference can be made to Chemical Reviews, vol.55, pp.335 to 483.

The tetrazolium compound represented by Formula may be used alone to obtain preferred image characteristics. Discretionally combined use of two or more kinds of the compound does not adversely affect the image characteristics. The tetrazolium compound of Formula T may be used in arbitrary combination with other tetrazolium compounds.

For the addition of the tetrazolium compound of Formula T to a silver halide emulsion, the compound may be added in the form of a solution of it dissolved in water or organic solvents including alcohols such as methanol, ethanol; ethers; esters, and the like. An overcoat process may be employed to add the compound to the outermost layer on the silver halide emulsion layer side of a silver halide light-sensitive material.

The preferred as the hydrazine derivative used in the invention are those compounds represented by the following Formula H:

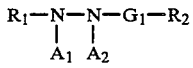

Formula H wherein $R_1$ is an aliphatic group, an aromatic group or a heterocyclic group containing at least one sulfur or oxygen atom; $R_2$ is a hydrogen atom, an alkyl group, an aryl group, an alkoxy group, an aryloxy group, an amino group, a hydrazino group, a carbamoyl group, an oxycarbonyl group or a —O—R group, wherein R represents an alkyl group or a saturated heterocyclic group; and G is a carbonyl group, a sulfonyl group, a sulfoxy group,

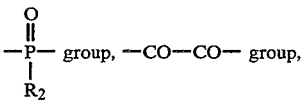

a thiocarbonyl group or an iminomethylene group; $A_1$ and $A_2$ each are a hydrogen atom, or either one of them is a hydrogen atom, while the other is a substituted or unsubstituted alkylsulfonyl group, a substituted or unsubstituted arylsulfonyl group or a substituted or unsubstituted acyl group.

In Formula H, the aliphatic group represented by $R_1$ is preferably one having 1 to 30 carbon atoms, and more preferably a straight-chain, branched-chain or cyclic alkyl group having 1 to 20 carbon atoms, wherein the branched-chain alkyl group may be cyclized to form a saturated heterocyclic group containing one or more hetero atoms. This alkyl group may have a substituent such as an aryl group, an alkoxy group, a sulfoxy group, a sulfonamido group or a carboamido group.

The aromatic group represented by $R_1$ of Formula H is a monocyclic or bicyclic aryl group or a unsaturated heterocyclic group, wherein the unsaturated heterocyclic group may be condensed with the monocyclic or bicyclic aryl group to form a heteroaryl group, which comprises, e.g., benzene ring, naphthalene ring, pyridine ring, pyrimidine ring, imidazole ring, pyrazole ring, quinoline ring, isoquinoline ring, benzimidazole ring, thiazole ring or benzothiazole ring, among which the preferred is one containing the benzene ring.

The particularly preferred as $R_1$ is an aryl group.

The aryl group or unsaturated heterocyclic group represented by $R_1$ may have a substituent, typical examples of which include an alkyl group, an aralkyl group, an alkenyl group, an alkynyl group, an alkoxy group, an aryl group, a substituted amino group, an acylamino group, a sulfonylamino group, a ureido group, a urethane group, an aryloxy group, a sulfamoyl group, a carbamoyl group, an alkylthio group, an arylthio group, a sulfonyl group, a sulfinyl group, a hydroxy group, a halogen atom, a cyano group, a sulfo group, an alkyloxycarbonyl group, an aryloxy carbonyl group, an acyl group, an alkoxycarbonyl group, an acyloxy group, a carboamido group, a sulfonamido group, a carboxyl group, a phosphoric acid amido group, a diacylamino group, an imido group, and a $R_2$—NHCONR$_2$—CO— group. Of these the preferred substituents are a straight-chain, branched-chain or cyclic alkyl group having preferably 1 to 20 carbon atoms; an aralkyl group comprising a monocyclic or bicyclic alkyl moiety having preferably 1 to 3 carbon atoms; an alkoxy group having preferably 1 to 20 carbon atoms; a substituted amino group, preferably one substituted by an alkyl group having 1 to 20 carbon atoms; an acylamino group having preferably 2 to 30 carbon atoms; a sulfonamido group having preferably 1 to 30 carbon atoms; a ureido group having preferably 1 to 30 carbon atoms; and a phosphoric acid amido group having preferably 1 to 30 carbon atoms.

The alkyl group represented by $R_2$ of Formula H is preferably an alkyl group having 1 to 4 carbon atoms, which may have a substituent such as a halogen atom, a cyano group, a carboxy group, a sulfo group, an alkoxy group, a phenyl group, an acyl group, an alkoxycarbonyl group, an aryloxycarbonyl group, a carbamoyl group, an alkylsulfo group, an arylsulfo group, a sulfamoyl group, a nitro group, an aromatic heterocyclic group, or

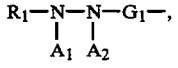

and these substituents each may be further substituted.

The aryl group is preferably a monocyclic or bicyclic aryl group, such as one containing a benzene ring. The aryl group may have a substituent, examples of which include the same groups as those defined in the above alkyl group.

The alkoxy group is preferably an alkoxy group having 1 to 8 carbon atoms, which may be substituted by a halogen atom or an aryl group.

The aryloxy group is preferably a monocyclic one, which may have a substituent such as a halogen atom.

The amino group is preferably a unsubstituted amino group, or an alkylamino or arylamino group having 1 to 10 carbon atoms, which may have a substituent such as an alkyl group, a halogen atom, a cyano group, a nitro group or a carboxy group.

The carbamoyl group is preferably a unsubstituted carbamoyl group, an alkylcarbamoyl or arylcarbamoyl group having 1 to 10 carbon atoms, which may have a substituent such as an alkyl group, a halogen atom, a cyano group or a carboxy group.

The oxycarbonyl group is preferably an alkoxycarbonyl or aryloxy carbonyl group having 1 to 10 carbon atoms, which may have a substituent such as an alkyl group, a halogen atom, a cyano group or a nitro group.

The preferred among these groups represented by $R_2$, where $G_1$ is a carbonyl group, are a hydrogen atom; an alkyl group such as methyl, trifluoromethyl, 3-hydroxypropyl, 3-methanesulfonamidopropyl or phenylsulfonylmethyl; an aralkyl group such as o-hydroxybenzyl; an aryl group such as phenyl, 3,5-dichlorophenyl, o-methanesulfonamidophenyl or e-methanesulfonylphenyl. Particularly, a hydrogen atom is preferred.

Where $G_1$ is a sulfonyl group, $R_2$ is preferably an alkyl group such as methyl; an aralkyl group such as o-hydroxyphenylmethyl; an aryl group such as phenyl; or a substituted amino group such as dimethylamino group.

Where $G_1$ is a sulfoxy group, the preferred as $R_2$ is a cyanobenzyl group or a methylthiobenzyl group, while where $G_1$ is

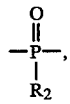

$R_2$ is preferably a methoxy, ethoxy, butoxy, phenoxy or phenyl group, and most preferably a phenoxy group.

Where $G_1$ is a N-substituted or unsubstituted iminomethylene, the preferred as $R_2$ is a methyl group, an ethyl group or a unsubstituted phenyl group.

Examples of a substituent to $R_2$ are the same as those defined for $R_1$.

$G_1$ of Formula H is most preferably a carbonyl group.

$R_2$ of Formula H may be one that splits the $G_1$—$R_2$ moiety from the rest thereof and generates a cyclization reaction to produce a cyclic structure containing the atom of the —$G_1$—$R_2$ moiety; particularly, one represented by Formula (a):

—$R_3$—$Z_1$ Formula (a)

wherein $Z_1$ is a group that nucleophilically attacks $G_1$ to split the $G_1$—$R_3$—$Z_1$ moiety from the rest of the molecules; $R_3$ is one formed by excluding one hydrogen atom from $R_2$ and which enables to form a cyclic structure with $G_1$, $R_3$ and $Z_1$ when $Z_1$ nucleophilically attacks $G_1$.

Particularly, $Z_1$ is liable to nucleophilically react with $G_1$ when the hydrazine compound having Formula H is oxidized to produce the following reaction intermediate, $$R_1—N{=}N—G_1—R_3—Z_1$$

and is capable of splitting the $R_1—N{=}N—$ group from $G_1$. More particularly, $Z_1$ may be a functional group that directly reacts with $G_1$ like —OH, —SH, —$NHR_4$, ($R_4$ is a hydrogen atom, an alkyl group, an aryl group, —$COR_5$ or —$SO_2R_5$, wherein $R_5$ is a hydrogen atom, an alkyl group, an aryl group or a heterocyclic group) or COOH, (wherein —OH, —SH, —$NHR_4$, and COOH may be temporarily protected so as to have these groups produced by alkali hydrolysis), or a functional group that becomes able to react with $G_1$ as a result of the reaction thereof with a nucleophilic agent such as hydroxylic ion or sulfate ion as in the case of $$-C-\overset{\overset{\displaystyle O}{\|}}{C}-R_6,\quad -C-\overset{\overset{\displaystyle N-R_7}{\|}}{C}-R_6$$

wherein $R_6$ and $R_7$ each are a hydrogen atom, an alkyl group, an alkenyl group, an aryl group or a hetero or heterocyclic group.

The ring formed wity $G_1$, $R_3$ and $Z_1$ is preferably a 5- or 6-member ring.

The preferred among the groups represented by Formula (a) are those represented by Formulas (b) and (c):

Formula (b)

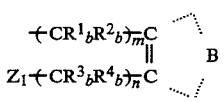

wherein $R_b^1$ to $R_b^4$ each represent a hydrogen atom, an alkyl group (preferably one having 1 to 12 carbon atoms), an alkenyl group (preferably one having 2 to 12 carbon atoms) or an aryl group (preferably one having 6 to 12 carbon atoms) and may be either the same or different; B is an atom necessary to complete a 5- or 6-member ring which may have a substituent; and m and n each are an integer of zero or 1, provided n+m equals 1 or 2.

The 5- or 6-member ring formed by B is, for example, a cyclohexene ring, a cyclobutene ring, a naphthalene ring, a pyridine ring or a quinoline ring.

$Z_1$ is as defined for the $Z_1$ of Formula (a).

Formula (c)

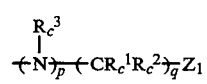

wherein $R_C^1$ and $R_C^2$ each represent a hydrogen atom, an alkyl group, an alkenyl group, an aryl group or a halogen atom, and may be either the same or different; $R_C^3$ is a hydrogen atom, an alkyl group, an alkenyl group or an aryl group; p is an integer of zero or 1; and q is an integer of 1 to 4. $R_C^1$, $R_C^1$, and $R_C^3$ may combine with one another to form a ring as long as $Z_1$ is of a structure capable of intramolecular-nucleophilically attacking $C_1$.

$R_C^1$ and $R_C^2$ each are preferably a hydrogen atom, a halogen atom or an alkyl group, while $R_C^3$ is preferably an alkyl group or an aryl group. q is preferably an integer of 1 to 9, provided when q is 1, p is 0 or 1; when q is 2, p is 0 or 1; when q is 3, p is 0 or 1; and when q is 2 or 3, $R_C^1$ and $R_C^2$ may be either the same or different. $Z_1$ is the same as the $Z_1$ defined in Formula (a).

$A_1$ and $A_2$ each are preferably a hydrogen atom, an alkylsulfonyl group, an arylsulfonyl group (preferably a phenylsulfonyl group or a phenylsulfonyl group which is substituted so that the sum of Hammett's substituent constants of it comes to −0.5 or more), an acyl group having not more than 20 carbon atoms (preferably a benzoyl group or a benzoyl group which is substituted so that the sum of Hammett's substituent constants of it comes to −0.5 or more, or straight-chain, branched-chain or cyclic unsubstituted and substituted aliphatic acyl groups (examples of the substituent thereto include a halogen atom, an ether group, a sulfonamido group, a carboamido group, a hydroxy group, a carboxy group and a sulfone group.)). The most preferred as $A_1$ or $A_2$ is a hydrogen atom.

$R_1$ or $R_2$ of Formula H may be one into which is incorporated a ballast group or polymer that is usually used in immobile photographic additives such as couplers. The ballast group is a group having 8 or more carbon atoms and relatively inert to photographic characteristics, and can be selected from among alkyl, alkoxy, phenyl, alkylphenyl, phenoxy and alkylphenoxy groups. Examples of the above-mentioned polymer include those as described in, e.g., JP O.P.I. No. 100530/1989.

$R_1$ or $R_2$ of Formula H may be one into which is incorporated a group capable of increasing its adsorbability to the silver halide grain surface. Examples of the adsorbability-increasing group include thiourea, heterocyclic thioamido, mercapto heterocyclic, triazole and the like groups as described in U.S. Pat. Nos. 4,385,108 and 4,459,347, JP O.P.I. Nos. 195233/1984, 200231/1984, 201045/1984, 201046/1984, 201047/1984, 201048/1984, 201049/1984, 170733/1986, 270744/1986 and 948/1987, JP Application Nos. 67508/1987, 67501/1987 and 67510/1987.

Out of these the suitably usable compounds for the invention are those represented by the following Formulas H-a, H-b, H-c or H-d.

Formula H-a $$R_{23}(NR_{24})_nC\overset{\overset{\displaystyle Y}{|}}{\underset{\underset{\displaystyle R_{25}}{|}}{N}}-(R_{26}-L)_m-R_{27}-NHNHC\overset{\overset{\displaystyle O}{\|}}{}-\overset{\overset{\displaystyle O}{\|}}{C}-R_{28}$$

wherein $R_{23}$ and $R_{24}$ each represent a hydrogen atom, a substituted or unsubstituted alkyl group (such as methyl, ethyl, butyl, dodecyl, 2-hydroxypropyl, 2-cyanoethyl, 2-chloroethyl), a substituted or unsubstituted phenyl group, a naphthyl group, a cyclohexyl group, a pyridyl group, a pyrrolidyl group (such as phenyl, p-methylphenyl, naphthyl, α-hydroxynaphthyl, cyclohexyl, p-methylcyclohexyl, pyridyl, 4-propyl-2-pyridyl, pyrrolidyl, 4-methyl-2-pyrrolidyl); $R_{25}$ is a hydrogen atom, a substituted or unsubstituted benzyl group, an alkoxy group or an alkyl group (such as benzyl, p-methylbenzyl, methoxy, ethoxy, ethyl, butyl); $R_{26}$ and $R_{27}$ each are a divalent aromatic group (such as phenylene or naphthylene); Y is a sulfur atom or an oxygen atom; L represent a divalent linkage group (such as —$SO_2CH_2CH_2NH$—, —$SO_2NH$—, —$OCH_2SO_2NH$—, —O—, —CH=N—); $R_{28}$ is —NR'R" or —$OR_{29}$, wherein R', R" and $R_{29}$ each are a hydrogen atom, a substituted or unsubstituted alkyl group (such as methyl, ethyl, dodecyl); a phenyl group (such as phenyl, p-methylphenyl, p-methoxyphenyl); a naphthyl group (such as α-naphthyl, β-naphthyl); or a heterocyclic group (e.g., a unsaturated heterocyclic residue such as pyridine, thiophen, furan, or a saturated heterocyclic residue such as tetrahydrofuran, sulforan); provided R' and R" may combine together with a nitrogen atom to form a ring such as piperidine, piperazine, morpholine, and the like; m and n each are an integer of 0 or 1; and when $R_{28}$, represents —$OR_{29}$, Y preferably represents an ionic atom.

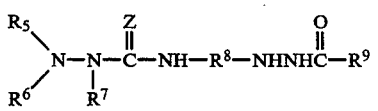

Formula H-b wherein $R^5$, $R^6$ and $R^7$ each are a hydrogen atom, an alkyl group (such as methyl, ethyl, butyl, 3-aryloxypropyl), a substituted or unsubstituted phenyl group, a naphthyl group, a cyclohexyl group, a pyridyl group, a pyrrolidyl group, a substituted or unsubstituted alkoxy group (such as methoxy, ethoxy, butoxy) or a substituted or unsubstituted aryloxy group (such as phenoxy, 4-methylphenoxy).

In the invention, $R^5$ and $R^6$ each are preferably a substituted alkyl group (substituent: an alkoxy or aryl group); $R^7$ is preferably a hydrogen atom or an alkyl group; $R^8$ is a divalent aromatic group (such as phenylene, naphthylene); Z is a sulfur atom or an oxygen atom; and $R^9$ is a substituted or unsubstituted alkyl group, an alkoxy group or an amino group, whose substituent is an alkoxy, cyano or aryl group.

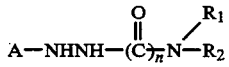

Formula H-c

A—NHNH—CO—CO—O—$R_3$ Formula H-d

In Formulas H-c and H-d, A represents an aryl group or a heterocyclic group containing at least one sulfur or oxygen atom; and n is an integer of 1 or 2, provided when n equals 1, $R_1$ and $R_2$ each are a hydrogen atom, an alkyl group, an alkenyl group, an alkynyl group, an aryl group, a heterocyclic group, a hydroxy group, an alkoxy group, an alkenyloxy group, an alkynyloxy group, an aryloxy group, or a heterocyclic oxy group, provided that $R_1$ and $R_2$ may combined together with the nitrogen atom to form a ring. When n equals 2, $R_1$ and $R_2$ each are a hydrogen atom, an alkyl group, an alkenyl group, an alkynyl group, an aryl group, a saturated or unsaturated heterocyclic group, a hydroxy group, an alkoxy group, an alkenyloxy group, an alkynyloxy group, an aryloxy group, or a heterocyclic oxy group, provided than when n equals 2, at least either one of $R_1$ and $R_2$ is an alkenyl group, an alkynyl group, a saturated heterocyclic group; a hydroxy group, an alkoxy group, an alkenyloxy group, an alkynyloxy group, an aryloxy group or a heterocyclic oxy group. $R_3$ represents an alkynyl group or a saturated heterocyclic group. The compounds represented by Formulas H-c or H-d include those in which at least either one of the Hs for the —NHNH— of the formula is substituted by a substituent.

To be more in detail, A is an aryl group (such as phenyl or naphthyl) or a heterocyclic group containing at least one sulfur or oxygen atom (such as thiophene, furan, benzothiophene, pyrane). $R_1$ and $R_2$ each represent a hydrogen atom, an alkyl group (such as methyl, ethyl, methoxyethyl, cyanoethyl, hydroxyethyl, benzyl, trifluoroethyl), an alkenyl group (such as allyl, butenyl, pentenyl, pentadienyl), an alkynyl group (such as propargyl, butynyl, pentynyl), an aryl group (such as phenyl, naphthyl, cyanophenyl, methoxyphenyl), a heterocyclic group (e.g., unsaturated heterocyclic residue such as pyridine, thiophene, furan, and saturated heterocyclic residue such as tetrahydrofuran, sulfofuran), a hydroxy group, an alkoxy group (such as methoxy, ethoxy, benzyloxy, cyanomethoxy), an alkenyloxy group (such as propargyloxy, butynyloxy), an aryloxy group (such as phenoxy, naphthyloxy), or heterocyclic oxy group (such as pyridyloxy, pyrimidyloxy), provided when n equals 1, $R_1$ and $R_2$ may combine together with the nitrogen atom to form a ring (such as piperidine, piperazine, morpholine); while when n equals 2, at least either one of $R_1$ and $R_2$ is an alkenyl group, an alkynyl group, a saturated heterocyclic group, a hydroxy group, an alkoxy group, an alkenyloxy group, an alkynyloxy group, an aryloxy group or a heterocyclic oxy group.

Examples of the alkynyl group and saturated heterocyclic group represented by $R_3$ are the same as those exemplified in above.

To the aryl group or the heterocyclic group having at least one sulfur or oxygen atom may be introduced one of various substituents such as a halogen atom, an alkyl group, an aryl group, an alkoxy group, an aryloxy group, an acyloxy group, an alkylthio group, an arylthio group, a sulfonyl group, an alkoxycarbonyl group, an aryloxycarbonyl group, a carbamoyl group, a sulfamoyl group, an acyl group, an amino group, an alkylamino group, an arylamino group, an acylamino group, a sulfonamido group, an arylaminothiocarbonylamino group, a hydroxy group, a carboxy group, a sulfo group, a nitro group and a cyano group; the preferred among these substituents is a sulfonamido group.

In Formulas H-c and H-d, A contains preferably at least one nondiffusible group or silver halide adsorption accelerating group. The preferred as the nondiffusible group is a ballast group that is usually used in immobile photographic additives such as couplers. The ballast group is a relatively photographically inert group having not less than 8 carbon atoms, which may be selected from the class consisting of an alkyl group, an alkoxy group, a phenyl group, an alkylphenyl group, a phenoxy group and an alkylphenoxy group.

Examples of the silver halide adsorption accelerating group include those as described in U.S. Pat. No. 4,385,108, such as a thiourea group, a thiourethane group, a heterocyclic thioamido group, a mercaptoheterocyclic group and a triazole group.

The H for the —NHNH— of Formulas H-c and H-d; i.e., the hydrogen atom of hydrazine may be substituted by a substituent such as a sulfonyl group (such as methanesulfonyl, toluene sulfonyl), an acyl group (such as acetyl, trifluoroacetyl, ethoxycarbonyl) or an oxalyl group (such as ethoxalyl, piruvoyl).

In the invention, more preferred compounds are those having Formula H-c, in which n equals 2, and those of Formula H-d.

The compound having Formula H-c, in the case of n=2, is preferably a compound in which $R_1$ and $R_2$ each are a hydrogen atom, an alkyl group, an alkenyl group, an alkynyl group, an aryl group, a saturated or unsaturated heterocyclic group, a hydroxy group or an alkoxy group, provided at least either one of $R_1$ and $R_2$ is an alkenyl group, an alkynyl group, a saturated heterocyclic group or an alkoxy group.

The following are typical examples of the compound represented by Formula H.

H-1

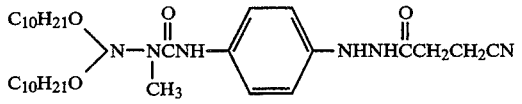

H-2

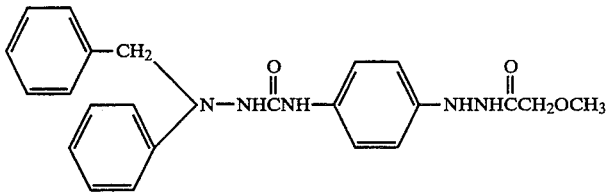

H-3

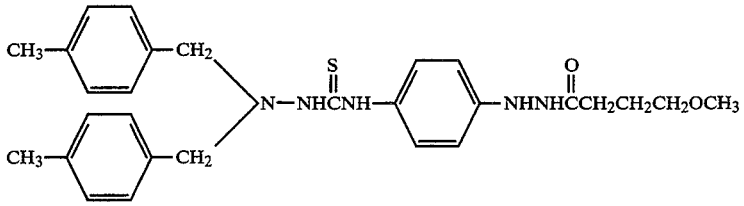

H-4

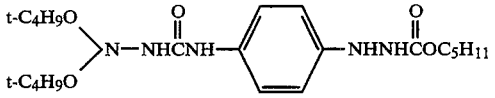

H-5

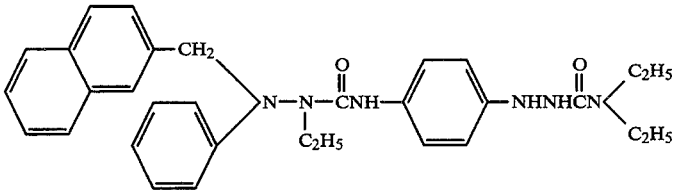

H-6

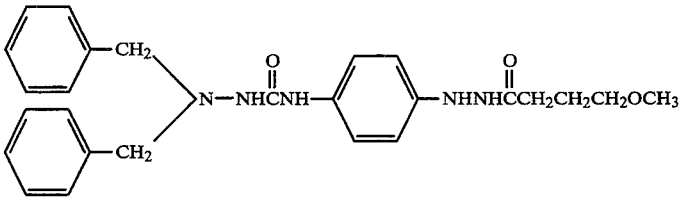

H-7

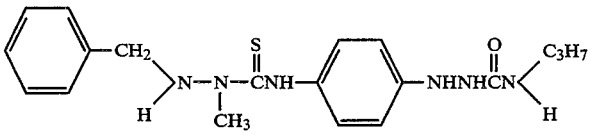

H-8

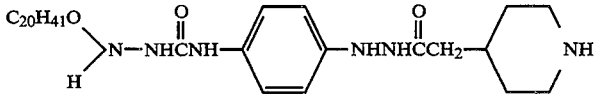

-continued
H-9
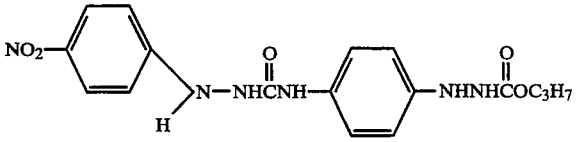
H-10
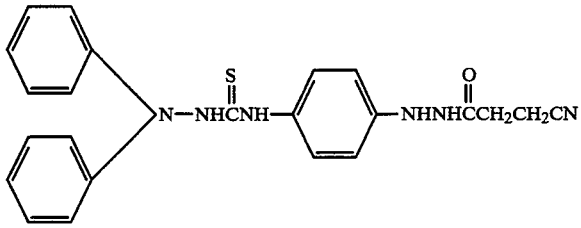
H-11
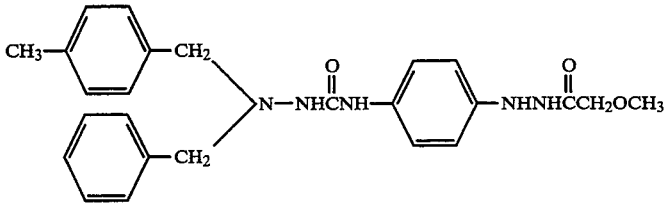
H-12
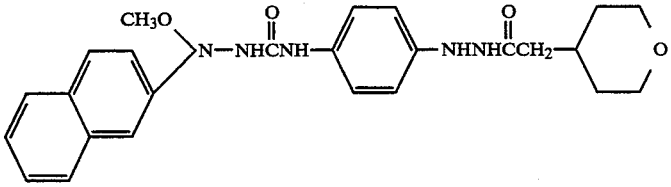
H-13
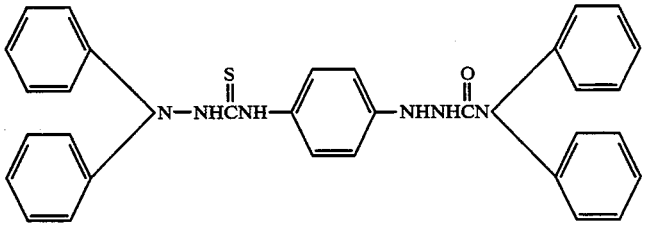
H-14
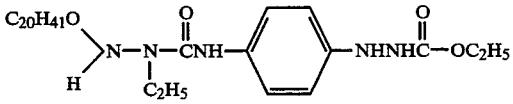
H-15
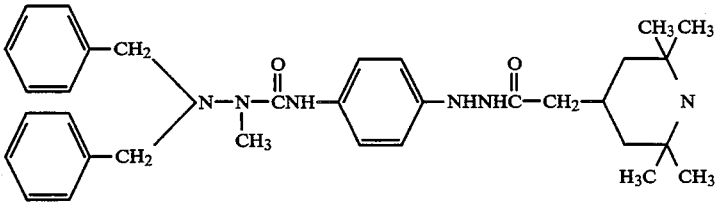
H-16
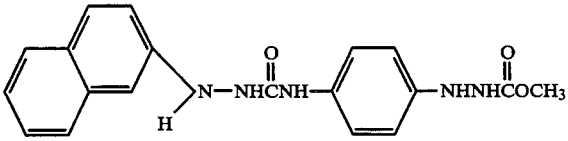

-continued
H-17
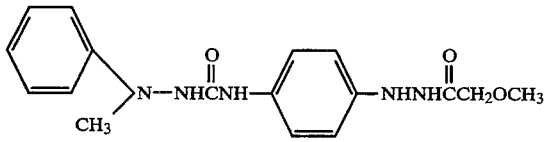
H-18
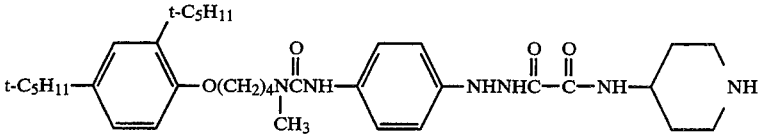
H-19
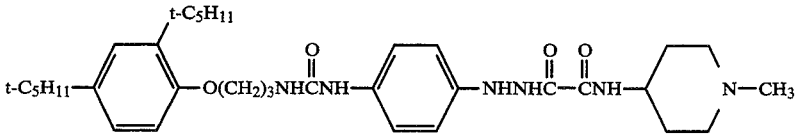
H-20
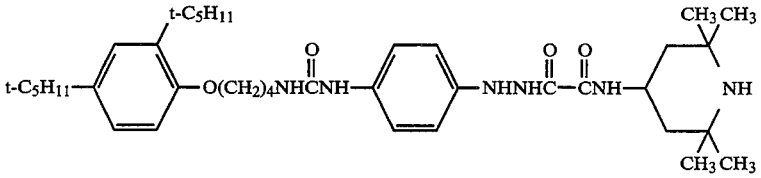
H-21
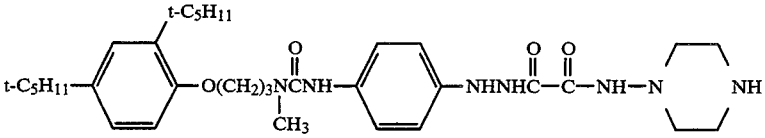
H-22
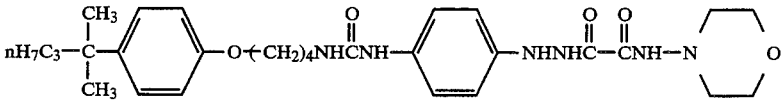
H-23
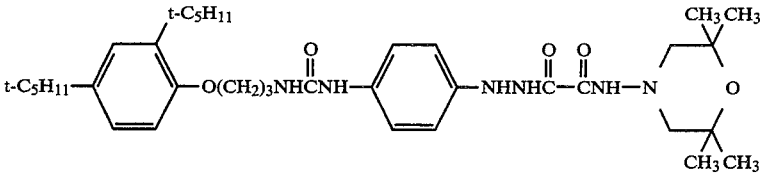
H-24
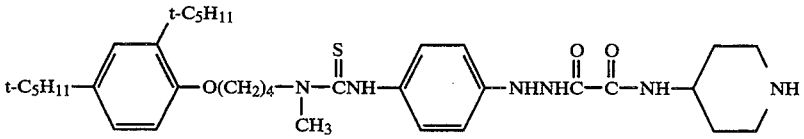
H-25
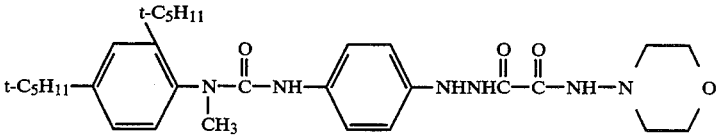
H-26
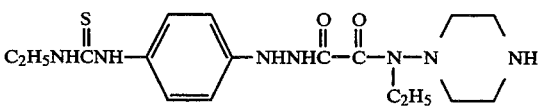

-continued
H-27
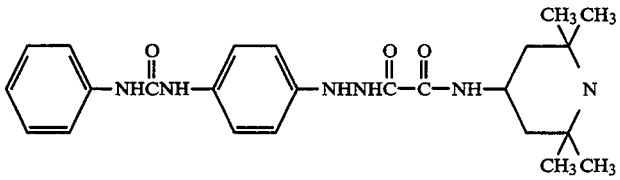
H-28
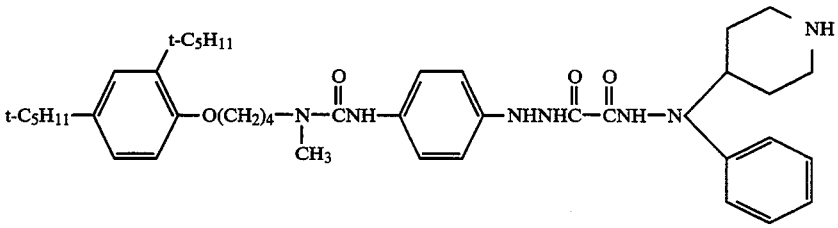
H-29
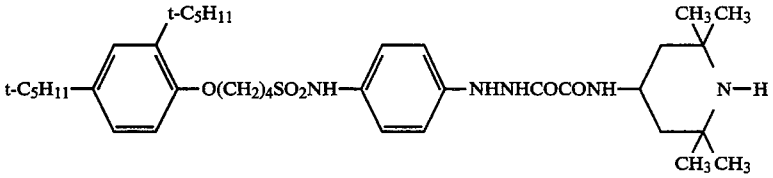
H-30
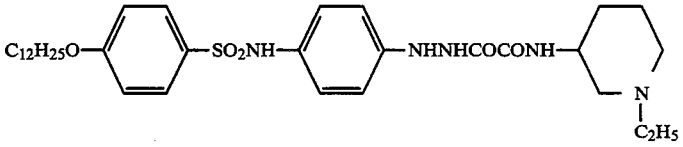
H-31
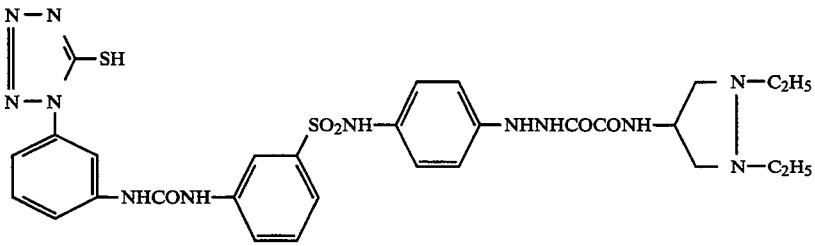
H-32
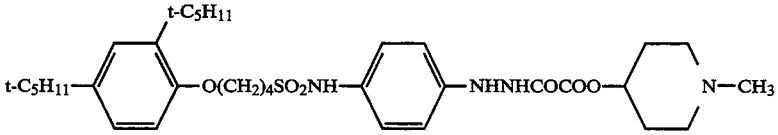
H-33
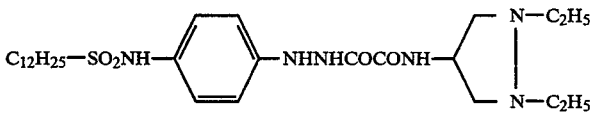
H-34
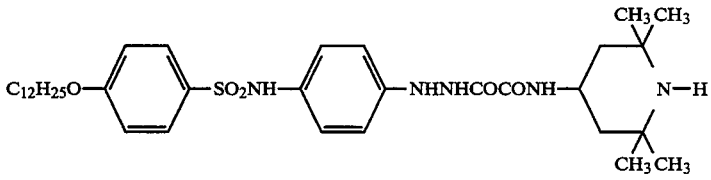
H-35
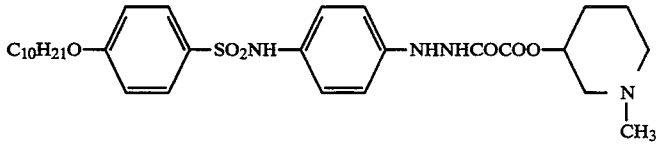

-continued

H-36

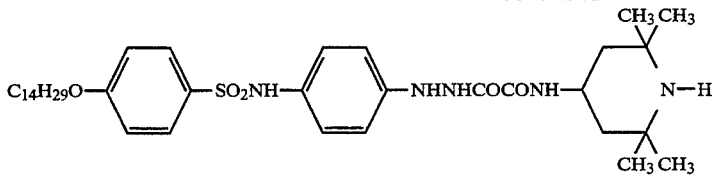

H-37

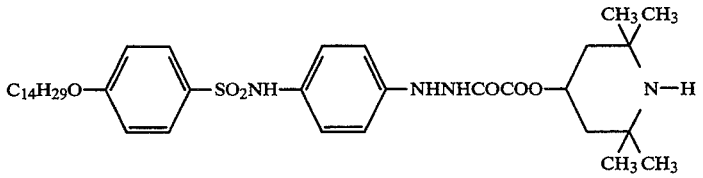

H-38

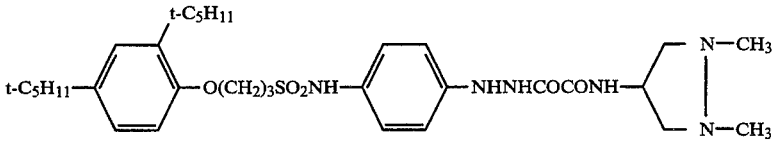

H-39

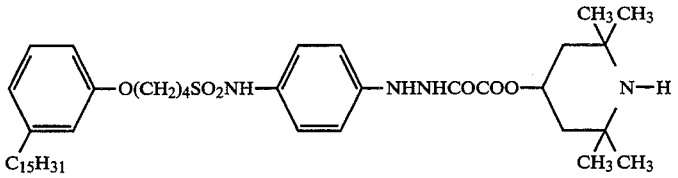

H-40

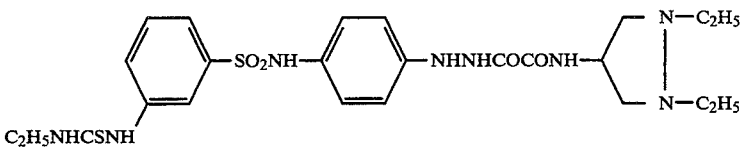

H-41

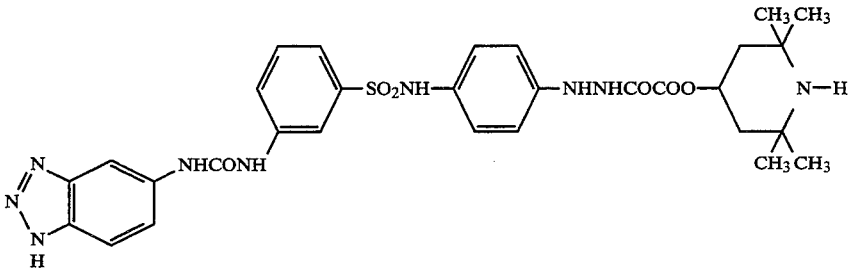

The listed in above are the examples of the compounds represented by Formulas H-a to H-d as the hydrazine derivative used in the invention. In addition, further examples of the compound having Formula H are given below:

H-42

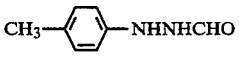

H-43

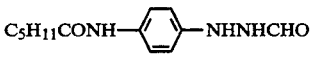

H-44

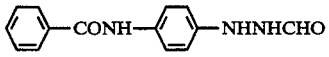

H-45

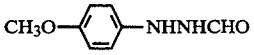

-continued

H-46

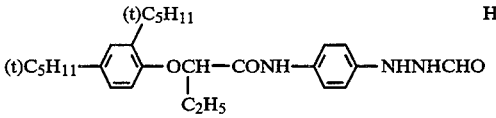

H-47

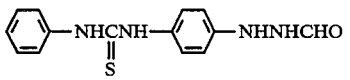

And Compounds II-7 to II-54, which are described in JP O.P.I. No. 174143/1991, pp.24 to 26.

The hydrazine derivative to be used in the invention is preferably a compound represented by the foregoing Formula H, but may also be a hydrazine compound having the following Formula H':

$R^1—NH—NH—R^2$ Formula H' wherein $R^1$ is a quinolyl group, a pyridyl group, a cyclohexyl group or a group represented by any one of the following Formulas (a) to (h).

(a)

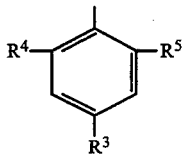

(b)

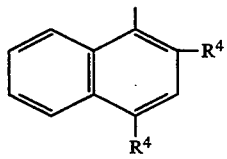

(c)

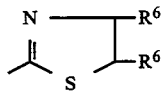

(d)

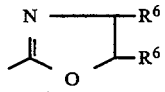

(e)

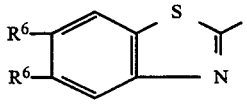

(f)

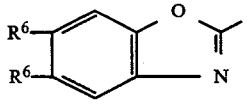

(g)

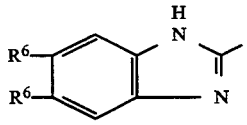

(h)

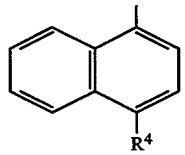

wherein $R^2$ is a hydrogen atom or a phenyl group; $R^3$ is a hydrogen atom, a halogen atom, an alkyl group having 1 to 4 carbon atoms, an alkoxy group or a sulfonamido group; $R^4$ and $R^5$ each are a hydrogen atom or a halogen atom; and $R^6$ is an alkyl group having 1 to 4 carbon atoms or an alkoxy group.

The following are examples of the compound represented by Formula H':

H'-1

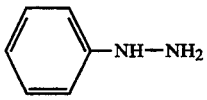

H'-2

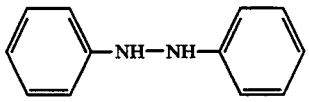

-continued

H'-3

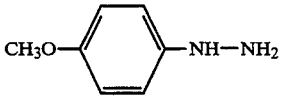

H'-4

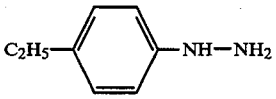

H'-5

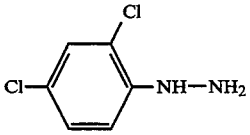

H'-6

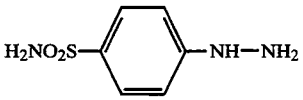

H'-7

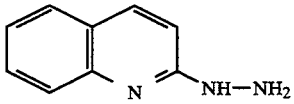

H'-8

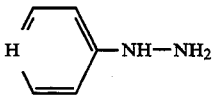

H'-9

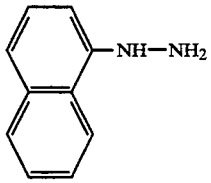

H'-10

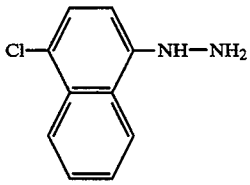

H'-11

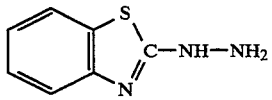

H'-12

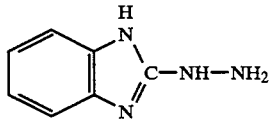

H'-13

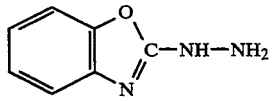

-continued

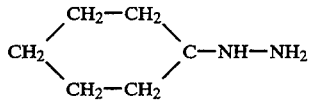

H'-14

Where the light-sensitive material contains a compound of Formula H-c or H-d as the hydrazine derivative, it is preferable for the light-sensitive material to contain in its silver halide emulsion layer and/or in its non-light-sensitive layer on the silver halide emulsion layer side of its support at least one of those nuclear-formation accelerating compounds described in JP Application No. 234203/1990, p.69.

The following are typical examples of the nuclear-formation accelerating compound.

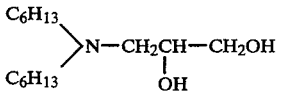

N-1

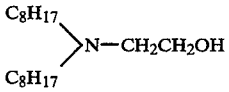

N-2

N-3

-continued

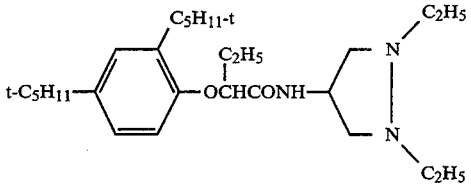

N-8

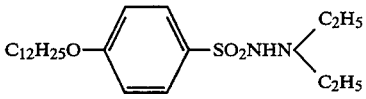

N-9

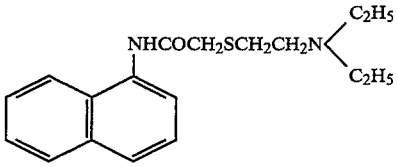

N-10

The cyclodextrin compound to be used in the invention is explained.

In the invention, the cyclodextrin compound includes cyclodextrins, cyclodextrin derivatives, branched cyclodextrins, and cyclodextrin polymers.

The cyclodextrin used in the invention is represented by the following Formula I:

Formula I

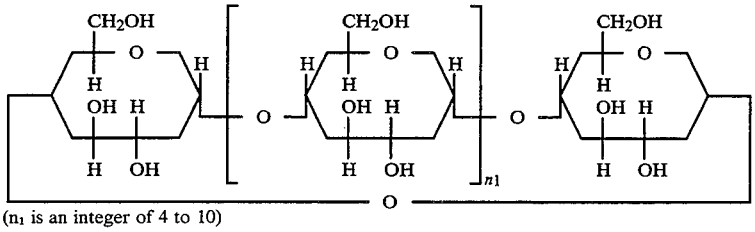

($n_1$ is an integer of 4 to 10)

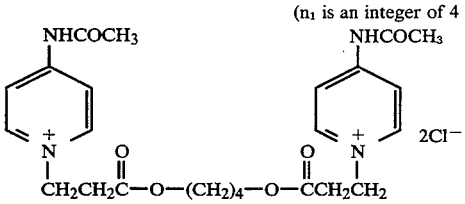

N-4

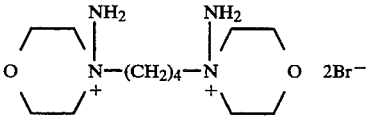

N-5

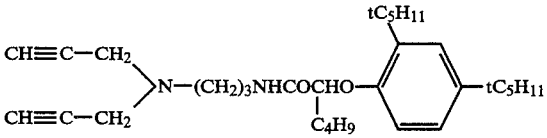

N-6

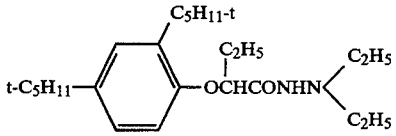

N-7

Of these compounds the particularly useful are α-cyclodextrin wherein $n_1=4$, β-cyclodextrin wherein $n_1=5$ and γ-cyclodextrin wherein $n_1=6$.

The cyclodextrin moiety of the compound used in the invention effects inclusion action to form a clathrate compound. It is possible in the invention to use the clathrate compound.

The clathrate compound of cyclodextrin, as described in, e.g., F. Cramer, 'Einschlus verbindungen' Springer (1954) or M. Hagao 'Clathrate Inclusion Compounds' Reinheld (1962), is a substance having a specific crystalline structure that is formed with certain atoms or molecules getting in a given composition ratio into a large cavity created inside a three-dimensional structure formed by the linkage of different atoms or molecules.

Examples of the cyclodextrin clathrate compound used in the invention include those represented by the following Formula $I_1$ or Formula $I_2$:

CD—(0—T)k Formula $I_1$ wherein CD represents a cyclodextrin residue; R is a hydrogen atom, an alkyl group, $R^2CO_2H$, $R^2SO_3H$, $R^2NH_2$ or $(R^2)_2$, wherein $R^2$ is a straight-chain or branched-chain alkylene group having 1 to 5 carbon atoms; and k is an integer of 1, 2, 3, 4 or 5.

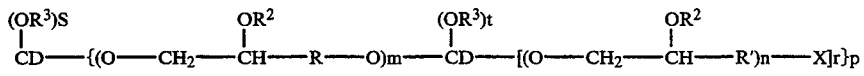

Formula $I_2$ wherein CD represents a group derived from β-cyclodextrin by the removal of (p+s) hydroxy group; R and R' each represent —$CH_2$—, —CH(OH)$CH_2$—, —$CH_2$CH(OH)$CH_2$—, —$CH_2$—O—($CH_2$)$_2$—O—$CH_2$CH(OH)—$CH_2$—, —$CH_2$—O—$CH_2$CH(OH)$CH_2$— or —$CH_2$—O—($CH_2$)$_4$—O—$CH_2$CH(OH)$CH_2$—; X represents —$OR^1$, —$OR^2$ or $NR^4R^5$, wherein $R^1$ is a hydrogen atom or, where r is not zero, a group derived by removing the hydroxy group from the β-cyclodextrin molecule; $R^3$ is a hydrogen atom, —PO(OH)$_3$, —$SO_3H$, —R'—NH($CH_2$)m—$CO_2H$, —$R^4$—($CO_2H$)u, —$R^4$—$SO_3H$, —$R^4$—$NR^5R^6$ or a group derived by removing the hydroxy group from β-cyclodextrin; $R^3$ is the same as defined for $R^3$ (except for the group derived from cyclodextrin); $R^4$ is a group having 1 to 10 carbon atoms derived from an alkane (the terminal carbon atom positioned near the polymer chain may, if necessary, be substituted by an oxo group); $R^5$ and $R^6$ each are a hydrogen atom or an alkyl group having 1 to 4 carbon atoms; m and n each are an integer of zero to 25, r is an integer of 1 to 17, p is an integer of 1 to 18, s and t each are an integer of zero to 7, and u is an integer of 1 to 5, provided that m, n, r, t and u may variously change within the unit; the sum of p+s is 18 or less.

The compound represented by Formula $I_1$ or $I_2$ may be used as a reduction sensitizer to a silver halide emulsion.

Examples of the compound represented by Formula $I_2$ are:

| Exemplified Compound No. | R | 1 |
|---|---|---|
| m-1 | —$CH^2COOH$ | 3 |
| m-2 | —$CH^2COOH$ | 5 |
| m-3 | —$(CH^2)^4SO^3H$ | 1 |
| m-4 | —$(CH^2)^4SO^3H$ | 3 |
| m-5 | —$N(C^2H^5)^2$ | 2 |

Subsequently, the cyclodextrin derivative is explained.

As the cyclodextrin derivative used in the invention there are known derivatives of the above cyclodextrin, whose hydroxyl group is etherified, esterified or aminated. These cyclodextrin derivatives are detailed in M. L. Bender and M. Komiyama, 'Cyclodextrin Chemistry', Shupringer-Ferlarg (1978).

The above etherified derivative of the cyclodextrin is a compound derived from the compound of Formula I by having its hydroxyl group alkylated to become an ether. The preferred among various ether derivatives thereof are those which are etherified at the second and sixth positions thereof, examples of which include heptakis-2,6-dimethyl-β-cyclodextrin, hexakis-2,6-dimethyl-α-cyclodextrin, and octakis-2,6-dimethyl-γ-cyclodextrin. For example, heptakis-2,6-dimethyl-β-cyclodextrin is well soluble, and has 10 times higher solubility in water than β-cyclodextrin, which is less soluble in water (1.85 g/100 ml); therefore it is possible to prepare a concentrated aquares solution of the derivative, so that much more merits of the derivative are expeted than β-cyclodextrin.

Next, the branched cyclodextrin used in the invention is explained.

The branched cyclodextrin used in the invention is one obtained by branch-addition or coupling of a water-soluble materials like monosaccharides or bisaccharides such as glucose, maltose, cellobiose, lactose, cane sugar, galactose or glucosamine to a known cyclodextrin; and preferably maltosyl cyclodextrin obtained by coupling maltose to cyclodextrin (coupled number of molecules of maltose may be any of 1, 2 or 3 molecules) or glucosyl cyclodextrin obtained by coupling glucose to cyclodextrin (coupled number of molecules of glucose may be any of 1, 2 or 3 molecules).

These branched cyclodextrin compounds may be synthesized according to the known synthesis methods described in the 'Denpun Kagaku' (Starch Chemistry), vol.33, No.2, p.119 to 126 (1986) and p.127 to 132 (1986); 'Denpun Kagaku' vol.30, No.2, p.231 to 239 (1983). For example, maltosyl cyclodextrin can be produced from cyclodextrin and maltose in the manner that an enzyme such as isoamylase or plunalase is employed to have maltose coupled to cyclodextrin. Glucosyl cyclodextrin can also be produced in like manner.

Suitable branched cyclodextrin compounds for the invention include the following exemplified compounds:

Exemplified Compounds

D-1 α-cyclodextrin coupled with 1 molecule of maltose
D-2 β-cyclodextrin coupled with 1 molecule of maltose
D-3 γ-cyclodextrin coupled with 1 molecule of maltose
D-4 α-cyclodextrin coupled with 2 molecules of maltose
D-5 β-cyclodextrin coupled with 2 molecules of maltose
D-6 γ-cyclodextrin coupled with 2 molecules of maltose
D-7 α-cyclodextrin coupled with 3 molecules of maltose
D-8 β-cyclodextrin coupled with 3 molecules of maltose
D-9 γ-cyclodextrin coupled with 1 molecules of maltose
D-10 α-cyclodextrin coupled with 1 molecule of glucose
D-11 B-cyclodextrin coupled with 1 molecule of glucose
D-12 γ-cyclodextrin coupled with 1 molecule of glucose
D-13 α-cyclodextrin coupled with 2 molecules of glucose
D-14 β-cyclodextrin coupled with 2 molecules of glucose
D-15 γ-cyclodextrin coupled with 2 molecules of glucose
D-16 α-cyclodextrin coupled with 3 molecules of glucose
D-17 β-cyclodextrin coupled with 3 molecules of glucose
D-18 γ-cyclodextrin coupled with 3 molecules of glucose The structures of these branched cyclodextrin compounds have so far been continuously investigated according to measuring methods such as the INEPT method, but are not established yet even by the scientific technology of today, thus in the stage of assumed structures. However, it is certain according to the above method that monosaccharides or disaccharides are coupled to cyclodextrin. Therefore, in the invention, where multimolecular monosaccharides or disaccharides are coupled to cyclodextrin, it includes cases where cyclodextrin is coupled separately with molecules of glucose and where cyclodextrin is coupled in the straight-chain form with one glucose.

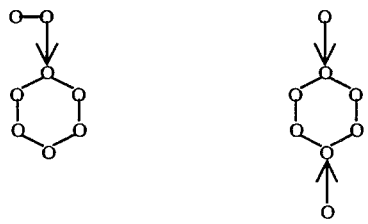

(Coupled in the straight chain form) (Coupled separately)

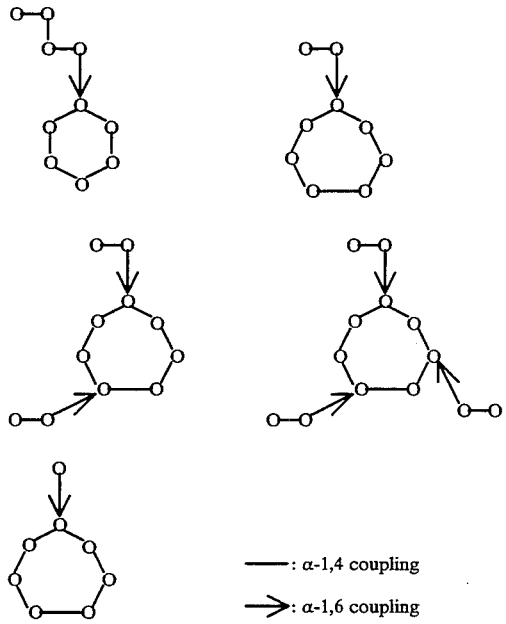

In the above branched cyclodextrin compound, the existing cyclodextrin's cyclic structure is retained intact, so that it shows a similar clathrate action to that of the existing cyclodextrin, and highly water-soluble maltose or glucose is added thereto to remarkably improve its solubility in water.

The branched cyclodextrin used in the invention is commercially available; for example, maltosyl cyclodextrin is commercially available under the trade name of 'Isoelete' (registered trademark ) from Ensuikoseito Co.

The branched cyclodextrin used in the invention is preferably in powdery form.

The cyclodextrin polymer to be used in the invention is explained.

As the cyclodextrin polymer used in the invention those represented by the following Formula II are suitable.

Formula II

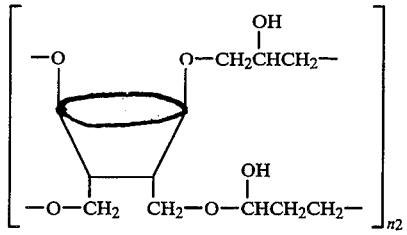

The cyclodextrin polymer used in the invention can be produced dy the closslinking polymerization of cyclodextrin with use of, e.g., epichlorohydrin.

The above cyclodextrin polymer has a solubility in water of preferably not less than 20 g per 100 ml of water at 25° C. In order to meet this requirement, the polymerization degree $n_2$ in the above Formula II needs to be 3 or 4. The smaller this value, the higher the water-solubility of the cyclodex trin itself and the solubilization effect of the foregoing material.

These cyclodextrin polymers can be synthesized in accordance with common methods as described in JP O.P.I. No. 97025/1986 and German Patent No. 3,544,842.

The above cyclodextrin polymer also may, as aforementioned, be used as a clathrate compound to a cyclodextrin polymer.

The water-soluble cyclodextrin polymer having a medium molecular weight can be prepared by several methods. According to one of these methods, firstly, cyclodextrin is transformed into a unsaturated polymerizable derivative, which is then polymerized as it is, or polymerized with a monomer free of cyclodextrin (as described in J. Polym. Sci. Letters, vol. 13, p.357, 1975). According to another method, the cyclodextrin molecule is transformed into a straight-chain or branched-chain-containing non-crosslinked water-soluble polymer derivative by use of a bifunctional reagent such as diepoxide or epichlorohydrin (as described in Hungarian Patent No. 180597), or into an ionic group-substituted water-soluble polymer product (as described in Hungarian Patent No. 191101). For the introduction of an ionic functional group there is used a reagent capable of reacting with an alcoholic hydroxy group in an alkaline medium that is used for preparation of the polymer. The above reagent, with, e.g., a haloalkylamine or haloalkanic acid, introduces an amino or carboxy group. Also, there may also be used a reagent capable of reacting with an epoxy group formed at the terminal of the chain during producing the epoxy group or polymer of a coupling agent.

In the invention, the cyclodextrin compound is added to a silver halide emulsion layer and/or its protective layer or to a developer solution for use in processing the same. The adding amount of the compound is preferably 0.1 to 8 g/m$^2$, more preferably 0.3 to 1.6 g/m$^2$ to the silver halide emulsion layer and/or its protective layer, and preferably 0.1 to 100 g/liter, more preferably 0.5 to 50 g/liter to the developer solution.

The cyclodextrin compound is preferably added to be adjacent to a nitrogen-containing heterocyclic compound in the development for image formation, so the compound can swiftly dissolve in the developer solution and give a remarkable effect.

The above water-less-soluble compound includes those represented by the following Formulas III, IV and V:

Formula III

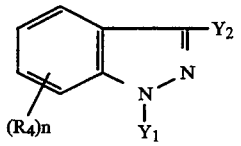

Formula IV

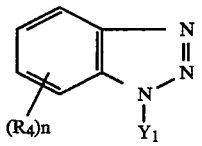

Formula V

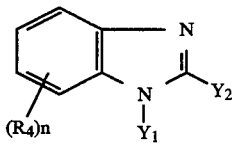

In Formulas III to V, $Y_1$ is a hydrogen atom, an alkali metal atoms or a mercapto group; $R_4$ and $Y_2$ each are a hydrogen atom, a halogen atom, a nitro group, an amino group, a cyano group, a hydroxyl group, a mercapto group, a sulfo group, a substituted or unsubstituted alkyl group, a substituted or unsubstituted alkenyl group, a substituted or unsubstituted alkynyl group, a substituted or unsubstituted alkoxy group, a hydroxycarbonyl group, an alkylcarbonyl group or an alkoxycarbonyl group; and n is an integer of 1 to 4.

Typical examples of the compound represented by Formula III are as follows, but are not limited thereto:

III-1 5-nitroindazole
III-2 6-nitroindazole
III-3 5-sulfoindazole
III-4 5-cyanoindazole
III-5 6-cyanoindazole
III-6 2-mercaptoindazole Typical examples of the compound represented by Formula IV are as follows, but are not limited thereto:

IV-1 Benzotriazole
IV-2 5-methylbenzotriazole
IV-3 5-chlorobenzotriazole
IV-4 5-nitrobenzotriazole
IV-5 5-ethylbenzotriazole
IV-6 5-carboxybenzotriazole
IV-7 5-hydroxybenzotriazole
IV-8 5-aminobenzotriazole
IV-9 5-sulfobenzotriazole
IV-10 5-cyanobenzotriazole
IV-11 5-methoxybenzotriazole
IV-12 5-ethoxybenzotriazole
IV-13 5-mercaptobenzotriazole Typical examples of the compound represented by Formula V are as follows, but are not limited thereto:

V-1 Benzimidazole
V-2 5-sulfobenzimidazole
V-3 5-methoxybenzimidazole
V-4 5-chlorobenzimidazole
V-5 5-nitrobenzimidazole
V-6 2-mercapto-5-sulfobenzimidazole The above are the compounds known as antifoggants in photographic fields. These can be synthesized in accordance with known synthesis methods, and some of them are commercially available as chemical reagents.

Where one of these compounds having Formulas III to V is added to a developer solution, its adding amount is preferably 0.0001 to 2 g per liter of the developer solution. If the added amount is less than the above range, the compound is unable to exhibit its antifogging effect, while if larger than the above amount, it lowers the sensitivity of a light-sensitive material in processing. To add the water-less-soluble antifoggant and cyclodextrin adjacently, the water-less-soluble antifoggant should be dissolved in an appropriate solvent such as methanol or ethanol and added to compositions for coating a silver halide emulsion layer and/or its protective layer, and further cyclodextrin should be incorporated in the same layer.

Alternatively, making the most of the cyclodextrin's characteristic as a cyclic compound, various clathrate compounds may be made from the cyclodextrin compound and a variety of water-less-soluble antifoggants, and the clathrate compound may be added. The clathrating may be made physically by dissolving solving cyclodextrin in water and the water-less-soluble antifoggant in a solvent and mixing both solutions at a high speed. The antifoggant-cyclodextrin mixing ratio is preferably 1:1 to 1:10, and more preferably 1:1 to 1:5.

The above adding manner enables the cyclodextrin compound and water-less-soluble antifoggant to swiftly dissolve with no solvent in a processing solution to thus enable the objective interaction thereof with silver halide grains.

In the invention, the 'processing in a solution containing a cyclodextrin compound' implies particularly a developing process. The developer contains various water-less-soluble antifoggrants, in which solvents such as alkanolamines, glycols, etc., are generally used in a large amount to dissolve the aforementioned water-less-soluble antifoggants or to prevent them from depositing. According to the invention, the amount of these solvents can be reduced extremely. To be concrete, the amount of the solvent in a developer solution is preferably 70 to 100 g, more preferably 30 to 60 g per gram of the water-less-soluble antifoggrant, and the amount of the cyclodextrin compound to be added at the time is preferably 1 to 30 g, more preferably 3 to 12 g per liter of a developer solution.

Preparation of a developer solution can be made with no solvent at all. In this case, the cyclodextrin compound and water-less-soluble antifoggrant can be added in the form of a clathrate compound thereof to the developer solution. The water-less-soluble antifoggant-cyclodextrin compound molar ratio used for the clathrate compound formation is preferably 1:1 to 1:20, more preferably 1:3 to 1:10; after physically high-speed mixing, a clathrate compound is extracted into an aqueous system, which may be added as it is.

By adopting the above manner, a developer solution can be prepared with no solvent at all.

For the silver halide emulsion layer of the invention there may be used light-sensitive silver halide grains having preferably an average grain diameter of 0.05 to 0.3 μm, wherein the average grain diameter, in the case of spherical grains, is the diameter thereof, while in the case of nonspherical grains, is the diamter of a circle equivalent in the area to the projection image thereof.

The silver halide emulsion is preferably of silver halide grains of which those having grain diameters within the average grain diameter±10% range account for 60% or more of the whole grains.

For the silver halide emulsion used in the silver halide emulsion layer of the invention (hereinafter called 'silver halide emulsion' or merely 'emulsion') there may be used any arbitrary silver halide for ordinary silver halide emulsions, such as silver bromide, silver iodide, silver iodochloride, silver chlorobromide and silver chloride; more preferably, silver chlorobromide containing not less than 60 mol % silver chloride as a negative-type silver halide emulsion; and silver chloride, silver chlorobromide containing not less than 10 mol % silver bromide, silver bromide or silver iodobromide as a positive-type silver halide emulsion.

The silver halide grain used in the silver halide emulsion may be any one produced according to an acidic, neutral or ammoniacal process. The grain may be grown at a time, or after once preparing a seed grain, the gain may be grown therefrom. The method of making seed grains and the method of growing grains may be either the same of different.

For preparation of the silver halide emulsion, halide ions and silver ions may be simultaneously mixed or either one may be mixed in a solution of the other. The silver halide grain may be grown by adding sequentially simultaneously halide ions and silver ions, taking into account the silver halide crystal's critical growing rate and controlling pH and pAg inside the mixture solution thereof. This method makes it possible to obtain silver halide grains having a regular crystal form and nearly uniform grain sizes. After growth of the grain, its halide composition may be changed.

The silver halide emulsion, during its preparation, may have its silver halide grain sizes, grain forms, grain size distribution and grain's growing rate controlled, if necessary, by using a silver halide solvent.

Examples of the silver halide solvent include ammonia, thioether, thiourea, thiourea derivatives such as 4-substituted thiourea and imidazole derivatives. For the thioether reference can be made to U.S. Pat. Nos. 3,271,157, 9,790,387 and 3,574,628.

The using amount of the solvent, in the case of a nonammonia solvent, is preferably $10^{-3}$ to 1.0% by weight, more preferably $10^{-2}$ to $10^{-1}$% by weight of the reaction solution and, in the case of ammonia, may be discretionarily selected.

The silver halide grain used in the silver halide emulsion may contain in the inside and/or surface thereof a metallic element by adding metallic ions thereto in the grain forming process and/or growing process, using at least one metallic salt selected from the class consisting of cadmium salts, zinc salts, lead salts, thalium salts, iridium salts including complex salts thereof, rhodium salts including complex salts thereof and iron salts including complex salts thereof; particularly a water-soluble rhodium salt is preferred. By being placed in an appropriate reductive atmosphere, the silver halide grain can be provided with reduction sensitization nucleus in the inside and/or surface thereof. Where a water-soluble rhodium salt is added, its adding amound is preferably $1\times10^{-7}$ to $1\times10^{-4}$ mol per mol of AgX.

The silver halide emulsion, after completion of its growth, may have its useless soluble salts either removed therefrom or remain unremoved. If the salt should be removed, the removal may be carried out according to Research Disclosure 17643.

The silver halide grain used in the silver halide emulsion may be either one having therein a uniform silver halide composition distribution or a core/shell grain with difference in the composition between the inside and the outside thereof.

The silver halide grain may be of the type of either forming a latent image mainly on its surface or forming a latent image mainly in its inside.

The silver halide grain may be in a regular crystal form such as a cubic, octahedral or tetradecahedral form or in an irregular crystal form such as a spherical or tabular form. Of these crystal grain forms any grain whose crystal is of an arbitrary {100} face-{111} face proportion may be used, or one in the complex form of these crystal forms or a mixture of grains having diverse crystal forms may also be used.

The silver halide emulsion in the invention may be a mixture of separately prepared two or more different silver halide emulsions.

The silver halide emulsion may be chemically sensitized in the usual manner; i.e., by single or combined use of sulfur sensitization, selenium sensitization, reduction sensitization and noble-metallic sensitization methods.

The sensitization of the silver halide emulsion is preferably carried out by use of appropriate one of the chemical sensitizers in accordance with appropriate one of the sensitizing methods described in British Patent Nos. 618,061, 1,315,755 and 1,396,696; JP E.P. No. 15748/1969; U.S. Pat. Nos. 1,574,944, 1,623,499; 1,673,522, 2,278,947, 2,399,083, 2,410,689, 2,419,974, 2,448,060, 2,487,850, 2,518,698, 2,521,926, 2,642,361, 2,694,637, 2,728,668, 2,743,182, 2,743,183, 2,983,609, 2,983,610, 3,021,215, 3,026,203, 3,297,446, 3,297,447, 3,361,564, 3,411,914, 3,554,757, 3,565,631, 3,565,633, 3,591,385, 3,656,955, 3,761,267, 3,772,031, 3,857,711, 3,891,446, 3,901,714, 3,904,415, 3,930,867, 3,984,249, 4,054,457 and 4,067,740; Research Disclosure 12008, 13452 and 13654; and T. H. James, The Theory of the Photographic Process, 4th Ed. Macmillan, 1977, pp.67–76.

The silver halide emulsion used in the light-sensitive material of the invention may be spectrally sensitized to required wavelength regions by use of dyes known to the photographic field. Sensitizing dyes may be used alone or in combination. Dyes having no spectral sensitization function or supersensitizers which are compounds substantially not absorbing visible rays but serving to increase the sensitization function of sensitizing dyes may be incorporated together with the above sensitizing dyes into the emulsion.

Useful examples of the sensitizing dye include cyanine dyes, merocyanine dyes, complex cyanine dyes, complex merocyanine dyes, holopolar-cyanine dyes, hemicyanine dyes, styryl dyes and hemioxanol dyes.

Particularly useful dyes are cyanine dyes, merocyanine dyes and complex merocyanine dyes. To these dyes may apply any of nuclei commonly utilized as the basic heterocyclic nucleus to cyanine dyes; such as pyrroline nucleus, oxazoline nucleus, thiazoline nucleus, pyrrole nucleus, oxazole nucleus, thiazole nucleus, selenazole nucleus, imidazole nucleus, tetrazole nucleus, pyridine nucleus and nuclei formed by fusion of an alicyclic hydrocarbon ring with these nuclei; and nuclei formed by fusion of an aromatic hydrocarbon ring with these nuclei, such as indolenine nucleus, benzindolenine nucleus, indole nucleus, benzoxazole nucleus, naphthoxazole nucleus, benzothiazole nucleus, naphthothiazole nucleus, benzoselenazole nucleus, benzimidazole nucleus and quinoline nucleus. These nuclei may be substituted on a carbon atom thereof.

Merocyanine dyes or complex halocyanine dyes may have a 5- to 6-member heterocyclic nucleus such as pyrazoline-5-one nucleus, thiohydantoin nucleus, 2-thiooxazolidine-2,4-dione nucleus, thiazolidine-2,4-dione nucleus, rhodanine nucleus, thiobarbituric acid nucleus as the ketomethylene-structure-having nucleus thereof.

Useful examples of the sensitizing dye for the blue-sensitive silver halide emulsion layer include those as described in West German Patent No. 929,080; U.S. Pat. Nos. 2,231,658, 2,493,748, 2,503,776, 2,519,001, 2,912,329, 2,656,959, 3,672,897, 3,694,217, 4,025,349 and 4,046,572; British Patent No. 1,242,588; and JP E.P. Nos. 14030/1969 and 24844/1977. Useful examples of the sensitizing dye for the green-sensitive silver halide emulsion layer include those cyanine dyes, merocyanine dyes and complex cyanine dyes as described in U.S. Pat. Nos. 1,939,201, 2,072,908, 2,739,149 and 2,945,763; and British Patent No. 505,979. Useful examples of the sensitizing dye for the red-sensitive silver halide emulsion layer include those cyanine dyes, merocyanine dyes and complex cyanine dyes as described in U.S. Pat. Nos. 2,269,234, 2,270,378, 2,442,710, 2,454,629 and 2,776,280. Further, the cyanine dyes or complex cyanine dyes described in U.S. Pat. Nos. 2,213,995, 2,493,748, 2,519,001, and West German Patent No. 929,080 may be used for the green-sensitive or red-sensitive silver halide emulsion.

These sensitizing dyes may be used either alone or in combination. Combination of sensitizing dyes is often used for the purpose of supersensitization. Examples of the combined use of sensitizing dyes are described in JP E.P. Nos. 4932/1968, 4933/1968, 4936/1968, 32753/1969, 25831/1970, 26474/1970, 11627/1971, 18107/1971, 8741/1972, 11114/1972, 25379/1972, 37443/1972, 28293/1973, 38406/1973, 38407/1973, 38408/1973, 41203/1973, 41204/1973, 6207/1974, 40662/1975, 12375/1978, 34535/1979 and 1569/1980; JP O.P.I. Nos. 33220/1975, 33828/1975, 38526/1975, 107127/1976, 115820/1976, 135528/1976, 151527/1976, 23931/1977, 51932/1977, 104916/1977, 104917/1977, 109925/1977, 110618/1977, 80110/1979, 25728/1981, 1483/1982, 10753/1983, 91445/1983, 153926/1983, 114533/1984, 116645/1984 and 116647/1984; and U.S. Pat. Nos. 2,688,545, 2,977,229, 3,397,060, 3,506,443, 3,578,447, 3,672,898, 3,679,428, 3,769,301, 3,814,609 and 3,837,862.

Examples of the dye used together with sensitizing dyes and having in itself no spectral sensitization effect or the substance not substantially absorbing visible rays but showing super-sensitization effect when used together with sensitizing dyes include the aromatic organic formaldehyde condensates described in U.S. Pat. No. 3,473,510; the cadmium salts, azaindene compounds and aminostilbene compounds substituted by a nitrogen-containing heterocyclic group described in U.S. Pat. Nos. 2,933,390 and 3,635,721. The combinations exemplified in U.S. Pat. Nos. 3,615,613, 3,615,641, 3,617,295 and 3,635,721 are particularly useful.

For the purpose of preventing the light-sensitive material from fogging during its manufacture, storage or photographic processing or of keeping its photographic characteristics stable, a compound known as an antifoggant or stabilizer to the photographic field may be added to the silver halide emulsion thereof during, upon completion of and/or after completion of its chemical ripening up to the time of its coating.

Examples of the antifoggant or stabilizer include azaindenes such as the pentazaindenes described in U.S. Pat. Nos. 2,713,541, 2,743,180 and 2,743,181, the tetrazaindenes described in U.S. Pat. Nos. 2,716,062, 2,444,607, 2,444,605, 2,756,147, 2,835,581 and 2,852,375, and Research Disclosure 14851, the triazaindenes described in U.S. Pat. No. 2,772,164, and the polymerized azaindenes described in JP O.P.I. No. 211142/1982; quaternary onium salts such as the thiazolium salts described in U.S. Pat. Nos. 2,131,038, 3,342,596 and 3,954,478, the pyrilium salts described in U.S. Pat. No. 3,148,067, and the phosphonium salts described in JP E.P. No.40665/1975; mercapto-substituted heterocyclic compounds such as the mercaptotetrazoles, mercaptotriazoles and mercaptodiazoles described in U.S. Pat. Nos. 2,403,927, 3,266,897 and 3,708,303, JP O.P.I. Nos. 135835/1980 and 71047/1984, the mercaptothiazoles described in U.S. Pat. No. 2,824,001, the mercaptobenzothiazoles and mercaptobenzimidazoles described in U.S. Pat. No. 3,937,987, the mercaptooxadiazoles described in U.S. Pat. No. 2,843,491, and the mercaptothiazoles described in U.S. Pat. No. 3,364,028; polyhydroxybenzenes such as the catechols described in U.S. Pat. No. 3,236,652 and JP E.P. No. 10256/1968, the resorcinols described in JP E.P. No. 44413/1981, and the gallates described in JP E.P. No. 4133/1968; azoles such as the tetrazoles described in West German Patent No. 1,189,380, the triazoles described in U.S. Pat. No. 3,157,509, the benzotriazoles described in U.S. Pat. No. 2,704,721, the urazoles described in U.S. Pat. No. 3,287,135, the pyrazoles described in U.S. Pat. No. 3,106,467, the indazoles described in U.S. Pat. No. 2,271,229 and the polymerized benzotriazoles described in JP O.P.I. No. 90844/1984; heterocyclic compounds such as the pyrimidines described in U.S. Pat. No. 3,161,515, the 3-pyrazolidones described in U.S. Pat. No. 2,751,297, and the polymerized pyrrolidones, i.e., polyvinylpyrrolidones described in U.S. Pat. No. 3,021,213; various restrainer precursors as described in JP O.P.I. Nos. 130929/1979, 137945/1984, 140445/1984, British Patent No. 1,356,142, U.S. Pat. Nos. 3,575,699 and 3,649,267; the sulfinic acid and sulfonic acid derivatives described in U.S. Pat. No. 3,047,939; and the inorganic salts described in U.S. Pat. Nos. 2,566,263, 2,839,405, 2,488,709 and 2,728,663.

For the whole hydrophilic colloid layers of the light-sensitive material of the invention there may be used as needed various photographic additives, within limits not to impair the effect of the invention, such as gelatin plasticizers, hardeners, surfactants, image stabilizers, UV absorbents, antistain agents, pH adjusting agents, antioxidants, antistatic agents, viscosity increasing agents, graininess improving agents, dyes, mordants, brightening agents, developing rate control agents, and matting agents. Useful examples of the plasticizer for the invention include those as described in JP O.P.I. No. 63715/1973, British Patent No. 1,239,337, U.S. Pat. Nos. 306,470, 2,327,808, 2,759,821, 2,772,166, 2,835,582, 2,860,980, 2,865,792, 2,904,434, 2,960,404, 3,003,878, 3,033,680, 3,713,790, 3,287,289, 3,361,565, 3,397,988, 3,412,159, 3,520,694, 3,520,758, 3,615,624, 3,635,853, 3,640,721, 3,656,956, 3,692,753 and 3,791,857.

Examples of the hardener include the aldehyde and aziridine compounds described in PB Report 19,921, U.S. Pat. Nos. 2,950,197, 2,964,404, 2,983,611 and 3,271,175, JP E.P. No. 40898/1971, and JP O.P.I. No. 91315/1975, the isooxazole compounds described in U.S. Pat. No. 331,609, the epoxy compounds described in U.S. Pat. No. 3,047,394, West German Patent No. 1,085,663, British Patent No. 1,033,518, and JP E.P. No. 35495/1973, the vinylsulfon compounds described in PB Report 19,920, West German Patent Nos. 1,100,942, 2,337,412, 2,545,722, 2,635,518, 2,742,308 and 2,749,260, British Patent No. 1,251,091, JP Application Nos. 54236/1970 and 110996/1973, U.S. Pat. Nos. 3,539,644 and 3,490,911, the acryloyl compounds described in JP Application No. 27949/1973 and U.S. Pat. No. 3,640,720, the carbodiimide compounds described in U.S. Pat. Nos. 2,938,892 and 4,061,499, JP E.P. No. 38715/1971, and JP Application No. 15095/1974, the triazine compounds described in West German Patent Nos. 2,410,973 and 2,553,915, U.S. Pat. No. 3,325,287, and JP O.P.I. No. 12722/1977, the polymer compounds described in British Patent No. 822,061, U.S. Pat. Nos. 3,623,878, 3,396,029 and 3,226,234, JP E.P. Nos. 18578/1972, 18579/1972 and 48896/1972, and other hardeners including maleimide, acetylene, methanesulfonate and N-methylol compounds. These hardeners may be used either alone or in combination. Useful examples of the combination are described in West German Patent Nos. 2,447,587, 2,505,746 and 2,514,245, U.S. Pat. Nos. 4,047,957, 3,832,181 and 3,840,370, JP O.P.I. Nos. 63062/1975 and 127329/1977, and JP E.P. No. 32364/1973. The most useful hardeners are those capable of reacting with the carboxy group of gelatin.

Useful examples of the UV absorbent include the benzophenone compounds described in JP O.P.I. No. 2784/1971, and U.S. Pat. Nos. 3,215,530 and 3,698,907, the butadiene compounds described in U.S. Pat. No. 4,045,229, the cinnamate compounds described in U.S. Pat. Nos. 3,705,805 and 3,707,375, and JP O.P.I. No. 49029/1977, and besides, those described in U.S. Pat. No. 3,499,762 and JP O.P.I. No. 48535/1979. Further, UV absorbing couplers such as α-naphthol cyan dye-forming couplers, and the UV absorbing polymers described in JP O.P.I. Nos. 111942/1983, 178351/1983, 181041/1983, 19945/1984 and 23344/1984 may also be used. These UV absorbents may be mordanted in specific layers.

Useful examples of the brightening agent include stilbene compounds, triazine compounds, pyrazoline compounds, coumarin compounds and acetylene compounds.

These compounds may be either water-soluble ones or insoluble ones which may be used in the form of dispersions.

Useful examples of the anionic surfactant include those containing carboxy, sulfo, phospho, sulfate and phosphate groups, such as alkyl carboxylates, alkyl sulfonates, alkyl benzenesulfonates, alkyl naphthalenesulfonates, alkyl sulfates, alkyl phosphates, N-acylalkyltaurates, sulfosuccinates, sulfoalkylpolyoxyethylene-alkylphenyl ethers, polyoxyethylenealkyl phosphates, and the like.

Useful examples of the amphoteric surfactant include amino acids, aminoalkylsulfonic acids, aminoalkyl sulfates or phosphates, alkylbetains, and amine oxides.

Useful examples of the cationic surfactant include alkylamine salts, aliphatic or aromatic quaternary ammonium salts, heterocyclic quaternary ammonium salts such as pyridinium and imidazolium, and aliphatic or aromatic heterocyclic group-containing phosphonium and sulfonium salts.

Useful examples of the nonionic surfactant include saponin (steroid compounds), alkylene oxide derivatives such as polyethylene glycol, polyethylene glycol/-polypropylene glycol condensates, polyethylene glycol-alkyl ethers, polyethylene glycol-alkylaryl ethers, polyethylene glycol esters, polyethylene glycol sorbitan esters, polyalkylene glycol-alkylamines or amides and silicone/polyethylene oxide adducts; glycidol derivatives such as alkynylsuccinic acid polyglyceride, alkylphenol polyglyceride; aliphatic acid esters of polyhydric alcohols; and alkyl esters of sugar.

Useful examples of the matting agent include the organic matting agents described in British Patent No. 1,055,713, U.S. Pat. Nos. 1,939,213, 2,221,873, 2,268,662, 2,332,037, 2,376,005, 2,391,181, 2,701,245, 2,992,101, 3,079,257, 3,262,782, 3,516,832, 3,539,344, 3,591,379, 3,754,924 and 3,767,448; and the inorganic matting agents described in West German Patent No. 2,592,321, British Patent Nos. 760,775, 1,60,772, U.S. Pat. Nos. 1,201,905, 2,192,241, 3,053,662, 3,062,649, 3,257,206, 3,322,555, 3,353,958, 3,370,951, 3,411,907, 3,437,484, 3,523,022, 3,615,554, 3,635,714, 3,769,020, 4,021,245 and 4,029,504.

Useful examples of the antistatic agent include the compounds described in British Patent No. 1,466,600, Research Disclosure Nos. 15840, 16258 and 16630, U.S. Pat. Nos. 2,327,828, 2,861,056, 3,206,312, 3,245,833, 3,428,451, 3,775,126, 3,963,498, 4,025,342, 4,025,463, 4,025,691 and 4,025,704.

As an embodiment of the invention it is preferable to use tetrazolium compound, a polyethylene oxide derivative, a quaternary phosphate compound or a hydrazine compound as a tone control agent that assists increasing the photographic image contrast.

The light-sensitive material of the invention preferably contains a polymer latex. The preferred as the polymer latex to be contained in the light-sensitive material are the vinyl polymer hydrates such as acrylates, methacrylates, styrene, etc., described in U.S. Pat. Nos. 2,772,166, 3,325,286, 3,411,911, 3,311,912 and 3,525,620, Research Disclosure No. 195 19551 (July 1980).

Suitably usable polymer latexes include methalkylacrylate homopolymers such as methyl methacrylate and ethyl methacrylate, styrene homopolymers, copolymers of methalkyl acrylate or styrene with acrylic acid, N-methylol-acrylamide or glycidol methacrylate, alkyl acrylate homopolymers such as methyl acrylate, ethyl acrylate and butyl acrylate, copolymers of an alkyl acrylate with acrylic acid or N-methylol acrylamide (preferably copolymerizable monomer such as acrylic acid is up to 30% by weight), butadiene homopolymers, copolymers of butadiene with styrene or butoxyymethylacrylamide-acrylic acid, and vinylidene chloride-methylacrylate-acrylic acid copolymers, and the like.

The average particle size range of the polymer latex used in the invention is preferably 0.005 to 1 μm, and more preferably 0.2 to 0.1 μm.

The polymer latex to be used in the invention may be incorporated into layers either on one side or on both sides of the support, and preferably on both sides of the support. Where the polymer latex is incorporated into layers on both sides of the support, the kinds and/or amounts thereof may be either the same of different.

The polymer latex may be added to any layer; for example, when it should be present on the silver halide emulsion layer-containing side of the support, it may be contained in the silver halide emulsion layer, in the topmost non-light-sensitive colloid layer usually called protective layer; or in any other layer; for example, if there is an intermediate layer between the silver halide light-sensitive layer and the topmost layer, it may of course be incorporated into the intermediate layer. In addition, the polymer latex may be incorporated into either any single layer or a plurality of layers (two or more layers).

Typical polymer latex compounds suitably usable in the invention are given in the following list L-1 to L-23.

L-1

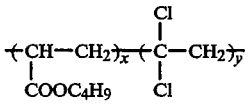

x/y = 50/50

(x, y, z that will be mentioned hereinafter, and w each represent a molar ratio: the same shall apply hereinafter)

L-2

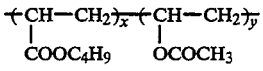

x/y = 50/50

L-3

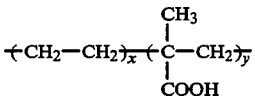

x/y = 95.6/4.4

L-4

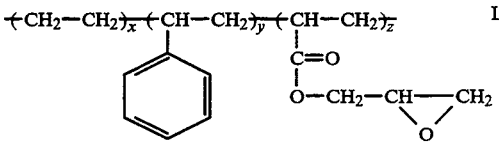

x/y/z = 40/20/40

L-5

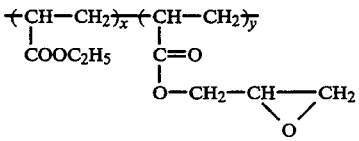

x/y = 50/50

L-6

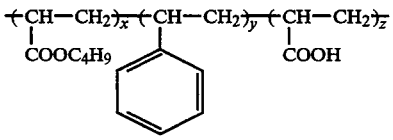

x/y/z = 39.4/59/1.6

L-7

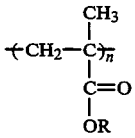

R: $-CH_3$, $-C_2H_5$, $-C_4H_9$

L-8

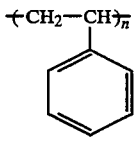

L-9

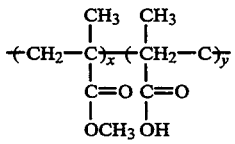

x/y = 93/7

-continued

L-10

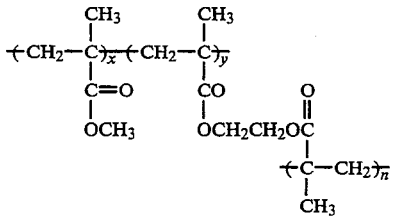

x/y = 93/7

L-11

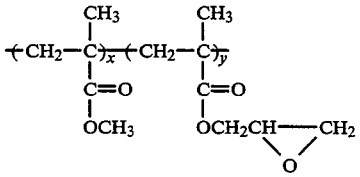

x/y = 93/7

L-12

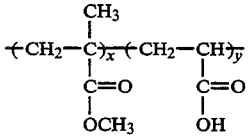

x/y = 93/7

L-13

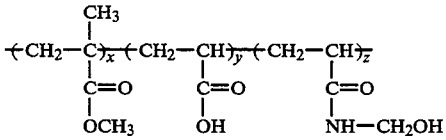

x/y/z = 93/3/4

L-14

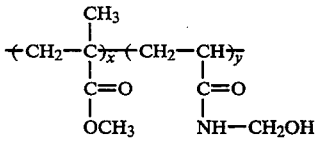

x/y = 93/7

L-15

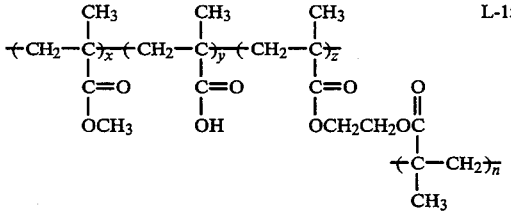

x/y/z = 93/3/4

L-16

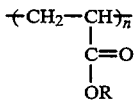

R: $-CH_3$, $-C_2H_5$, $-C_4H_9$

L-17

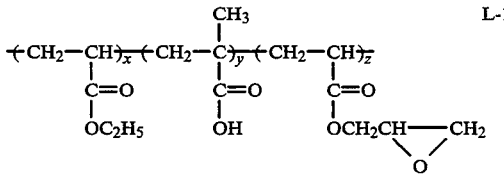

x/y/z = 93/3/4

-continued

L-18

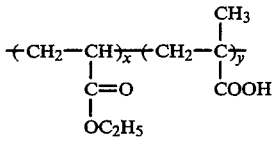

x/y = 93/7

L-19

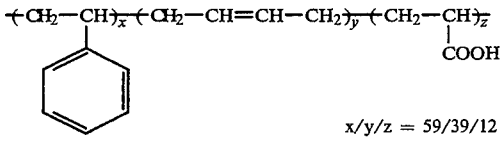

x/y/z = 59/39/12

L-20

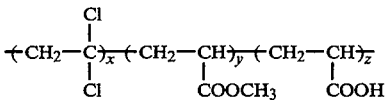

x/y/z = 85/13/2

L-21

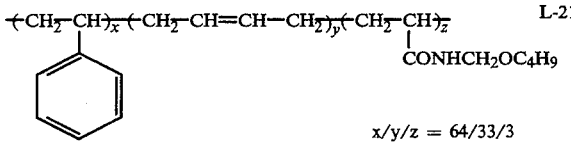

x/y/z = 64/33/3

L-22

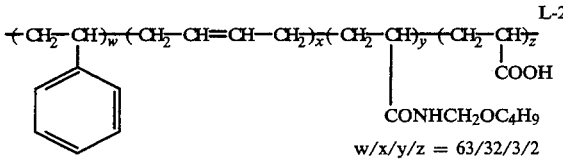

w/x/y/z = 63/32/3/2

L-23

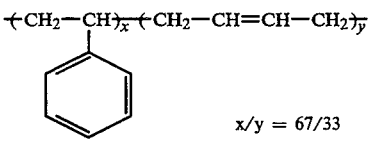

x/y = 67/33

As the binder of the light-sensitive material used in the invention there may be used gelatin or gelatin derivatives, and there may also be used in combination therewith cellulose derivatives, graft polymers of gelatin with other high polymers, other proteins, sugar derivatives, or hydrophilic colloids such as synthetic hydrophilic homo- or copolymer materials.

The above gelatin may be lime-treated gelatin, acid-treated gelatin, the enzyme-treated gelatin described in Bull. Soc. Sci. Phot. Japan, No.16, p.30 (1966), or hydrolyzed or enzyme-composed product of gelatin. Examples of the gelatin derivative include those obtained by the reaction of gelatin with various compounds such as acid halides, acid anhydrides, isocyanates, bromoacetic acid, alkanesultones, vinylsulfonamides, maleic acid imide compounds, polyalkylene oxides, epoxy compounds and the like, which are described in U.S. Pat. Nos. 2,614,928, 3,132,945, 3,186,846 and 3,312,553, British Patent Nos. 861,414, 1,033,189 and 1,005,784, and JP E.P. No. 26845/1967.

The above-mentioned protein includes albumin and casein, the cellulose derivative includes hydroxyethyl cellulose, carboxymethyl cellulose and cellulose sulfate, and the sugar derivative includes sodium alginate and starch derivatives. These are usable in combination with gelatin.

As the above graft polymer of gelatin with other polymer there may be used those gelatin-grafted homo- or copolymers comprising vinyl-type monomers such as acrylic acid, methacrylic acid, esters thereof, derivatives such as amides, acrylonitrile, styrenes, etc. Particularly preferred are the graft polymers obtained from those polymers relatively compatible with gelatin, comprising monomers such as acrylic acid, acrylamide, methacrylamide and hydroxyalkyl methacrylate. Examples of the above are described in U.S. Pat. Nos. 2,763,625, 2,831,767 and 2,956,884.

The coating weight of gelatin, where the light-sensitive material's proper plane contains no polymer latex except for its subbing layer, is preferably 1.0 g to 5.5 g/m$^2$ and more preferably 1.3 g to 4.5 g/m$^2$ on one side of the support.

Because of the demand for rapid processing in recent years, many studies have been made for reduction in the using amount of gelatin and prevention of the accompanying silver sludge; particularly there is a method for incorporating a polymer latex stabilized with gelatin into at least one of non-light-sensitive hydrophilic colloid layers, such as, for example, a method in which gelatin is used from the begining of latex synthesis to apply to protective layer.

An ordinary latex is made an aqueous dispersion by a surfactant, but the latex usable in the invention is a polymer latex characterized by having its surface and/or inside dispersedly stabilized by gelatin. The polymer and gelatin that constitute the latex may have some connection with each other. In this instance, the polymer and the gelatin may connect directly or indirectly, through a crosslinking agent, with each other. Accordingly, the monomers constituting the latex preferably include those containing a reactive group such as a carboxyl group, amino group, epoxy group, hydroxyl group, aldehyde group, oxazoline group, ether group, ester group, methylol group, cyano group, acetyl group, or unsaturated carbon linkage group. Where a crosslinking agent is used, it includes those usable as the crossling agent usually used for gelatin, such as aldehyde, glycol, triazine, epoxy, vinylsulfone, oxazoline, methacryl or acryl-type crosslinking agent.

The above polymer latex can be obtained in the manner that after completion of the polymer latex polymerization reaction, a gelatin solution is added to the reaction system for its reaction therewith. It is preferable that the reaction between the polymer latex synthesized in a surfactant solution and gelatin be made by use of a crosslinking agent. A method of effecting the latex polymerization reaction in the presence of gelatin also provides satisfactory results. In this instance, it is preferable not to use any surfactant during the polymerization reaction, but if the use of a surfactant is necessary, its adding amount is preferably 0.1 to 3% and more preferably 0.1 to 1.5% of the polymer component. The gelatin/polymer proportion at the time of syntheses is preferably 1/100 to 2/1, and more preferably 1/50 to 1/2.

The content of the latex is 30% or more, and preferably 30% to 200% based upon the gelatin content. The coating amount of the latex is preferably 50 mg/m$^2$ to 5 g/m$^2$ and more preferably 100 mg/m$^2$ to 2.5 mg/m$^2$.

Examples of the polymer latex to be incorporated into the photographic light-sensitive material of the invention include the vinyl polymer hydrates such as acrylates, methacrylates and styrenes as described in U.S. Pat. Nos. 2,772,166, 3,325,286, 3,411,911, 3,311,912 and 3,525,620, and Research Disclosure No. 195 19551 (July 1980).

Useful examples of the polymer latex used in the invention include homopolymers of meta-alkyl acrylates such as methyl methacrylate or ethyl methacrylate; homopolymers of styrenes; copolymers comprising meta-alkyl acrylate, styrene, acrylic acid, N-methylolacrylamide, glycidol methacrylate, etc.; homopolymers of alkyl acrylates such as methyl methacrylate, ethyl acrylate, butyl acrylate; copolymers comprising alkyl acrylates, acrylic acid, N-methylolacrylamide, etc., (acrylic acid content as a copolymeric constituent is preferably up to 30% by weight); homopolymers of butadiene; copolymers of butadiene with one or more of styrene, butoxymethylacrylamide and acrylic acid; and vinylidene chloride-methyl acrylate-acrylic acid copolymers.

The gelatin for use in stabilizing the latex includes gelatin and gelatin derivatives, which may be used in combination with hydrophilic colloids including synthetic aqueous polymer materials such as cellulose derivatives, graft polymers of gelatin with other polymers, other proteins, sugar derivatives, and homo- and copolymers.

The above gelatin may be lime-treated gelatin, acid-treated gelatin, the acid-treated gelatin described in Bull. Soc. Sci. Phot. Japan, No.16, p.30 (1966), or a hydrolyzed product or enzyme-decomposed product of gelatin. As the gelatin derivative there may be used those obtained by the reaction of gelatin with various compounds such as acid halides, acid anhydrides, isocyanates, bromoacetic acid, alkanesaltons, vinylsulfonamides, maleic imido compounds, polyalkylene oxides, and epoxy compounds. Examples of the above are described in U.S. Pat. Nos. 2,614,928, 3,132,945, 3,186,846 and 3,312,553, British Patent Nos. 861,414, 1,033,189 and 1,005,784, and JP E.P. No. 26845/1967.

The above protein includes albumin and casein, the cellulose derivative includes hydroxyethyl cellulose, carboxymethyl cellulose and cellulose sulfate, the sugar derivative includes sodium alginate and starch derivatives. These are usable in combination with gelatin.

As the above graft polymer of gelatin with other polymer there may be used those gelatin-grafted homo- or copolymers comprising vinyl-type monomers such as acrylic acid, methacrylic acid, esters thereof, derivatives such as amides, acrylonitrile, styrenes, etc. Particularly preferred are the graft polymers obtained from those polymers relatively compatible with gelatin, comprising monomers such as acrylic acid, acrylamide, methacrylamide, hydroxyalkyl methacrylate, etc. Examples of the above are described in U.S. Pat. Nos. 2,763,625, 2,831,767 and 2,956,884.

The latex is required to be added to at least one non-light-sensitive hydrophilic colloid layer, and may also be added to other arbitrary layers (a plurality of non-light-sensitive hydrophilic colloid layers and/or light-sensitive hydrophilic colloid layers). It may be added to layers either on one side or on both sids of the support. The latex to be added may be a known latex. When added to both sides of the support, the kind and/or amount of the polymer latex to be incorporated into both sides may be either the same or different. The average particle size range of the polymer latex is preferably 0.005 to 1 μm, more preferably 0.02 to 0.5 μm. As the latex added to the non-light-sensitive layer, the above-mentioned latex is used. The following also are examples of monomer components for the latex polymer.

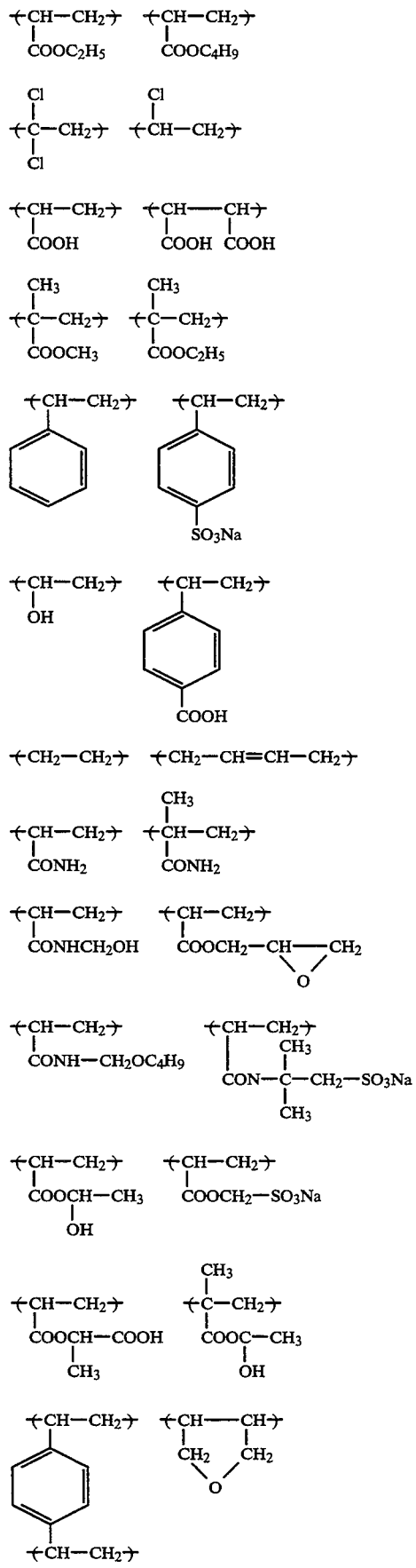

In the invention, the light-sensitive material may have one or more antistatic layers on the backing side and/or the emulsion layer side of the support in order to prevent the light-sensitive material from being troubled with static electricity. In this instance, the surface resistivity on the antistatic layer provided side of the support is preferably not more than $1.0\times10^{12}\ \Omega$, more preferably not more than $8\times10^{11}\ \Omega$ at 25° C./50$^5$ or lower. The above antistatic layer is preferably an antistatic layer containing a water-soluble conductive polymer, hydrophobic polymer particles and a reaction product of a hardener, or an antistatic layer containing a metallic oxide.

The above water-soluble conductive polymer is a polymer having at least one conductive group selected from the class consisting of a sulfonic acid group, sulfate group, quaternary ammonium salt, tertiary ammonium salt, carboxyl group and polyethylene oxide group. Out of these groups, the preferred are the sulfonic acid group, sulfate group and quaternary ammonium group. The conductive group is required to be in an amount of 5% by weight per molecule of the water-soluble conductive polymer.

The water-soluble conductive polymer may contain a carboxyl group, hydroxy group, amino group, epoxy group, aziridine group, active methylene group, sulfinic acid group, aldehyde group, vinylsulfone group and the like, but of these groups, the carboxyl group, hydroxy group, amino group, epoxy group, azylidine group and aldehyde group are preferred to be contained in the polymer. These groups need to be contained in an amount of not less than 5% by weight per molecule of the polymer. The average molecular weight of the water-soluble conductive polymer is from 3,000 to 100,000, preferably 3,500 to 50,000.

Useful examples of the above metallic oxide include tin oxide, indium oxide, antimony oxide, vanadium oxide, zinc oxide, and those obtained by doping these metallic oxides with metallic silver, metallic phosphorus or metallic indium. The average particle size of these metallic oxides is preferably 1 to 0.01 μm.

Useful examples of the support for the light-sensitive material of the invention include paper laminated with α-olefin polymer (such as polyethylene/butene copolymer), flexible reflective support such as synthetic paper, semisynthetic or synthetic polymer film such as of cellulose acetate, cellulose nitrate, polystyrene, polyvinyl chloride, polyethylene terephthalate, polycarbonate or polyamide, flexible support made of one of these films provided with a reflective layer. The most preferred among these materials is polyethylene terephthalate.

The subbing layer usable in the invention includes a subbing layer formed by coating an organic solvent solution of the hydroxybenzene described in JP O.P.I. No. 3972/1974, and those aqueous latex subbing layers as described in JP O.P.I. Nos. 11118/1974, 104913/1977, 19941/1084, 19940/1984, 18945/1984, 112326/1976, 117617/1976, 58469/1976, 114120/1976, 121323/1976, 123136/1976, 114121/1976, 139320/1977, 65422/1977, 109923/1977, 119919/1977, 65949/1980, 128332/1982 and 19941/1984.

The subbed surface of the support may be usually subjected to chemical or physical treatment, which includes treatment with chemicals, mechanical treatment, corona-discharge treatment, flame treatment, UV treatment, high-frequency treatment, glow-discharge treatment, active-plasma treatment, laser treatment, mixed-acid treatment, and ozone-oxidation treatment. No restrictions are placed on the subbing layer coating time and conditions.

In the invention, filter dyes, antihalation dyes or other dyes for various purposes may be used. The dyes usable in the invention include triallyl dyes, oxanol dyes, hemioxanol dyes, merocyanine dyes, cyanine dyes, styryl dyes and azo dyes. Particularly, the oxanol dyes, hemioxazol dyes and merocyanine dyes are useful. Examples of the usable dyes are those as described in West German Patent No. 616,007, British Patent Nos. 584,609 and 1,177,429, JP E.P. Nos. 7777/1951, 22069/1964 and 38129/1979, JP O.P.I. Nos. 85130/1973, 99620/1974, 114420/1974, 129537/1974, 28827/1975, 108115/1977, 185038/1982 and 24845/1984, U.S. Pat. Nos. 1,878,961, 1,884,035, 1,912,797, 2,098,891, 2,150,695, 2,274,782, 2,298,731, 2,409,612, 2,461,484, 2,527,583, 2,533,472, 2,865,752, 2,956,879, 3,094,418, 3,125,448, 3,148,187, 3,177,078, 3,247,127, 3,260,601, 3,282,699, 3,409,433, 3,540,887, 3,575,704, 3,653,905, 3,718,472, 3,865,817, 4,070,352 and 4,071,312, PB Report No.74175, and Photographic Abstract, 1 28 ('21).

Particularly, the use of these dyes is suitable for room-light-processing contact films, and it is preferable to use them so as to make a sensitivity to light of 400 nm 30 times as high as that to light of 360 nm.

Further, in practicing the invention, there may also be used an organic desensitizer whose polarograph's anode potential and cathode potential sum into positive as described in JP O.P.I. No. 26041.

The light-sensitive material of the invention can be exposed to electromagnetic waves in the spectral region to which the emulsion layer thereof is sensitive. As the light source usable in the invention there may be used any known light sources including natural light (sunlight), tungsten lamp light, iodoquartz light, mercury-arc lamp, microwave-emitting UV lamp, xenon arc light, carbon arc light, xenon flash light, cathode ray tube flying spot, various laser lights, light-emitting diode light, electron beam, and lights released from a phosphor excited by X-rays, γ-rays and α-rays. Satisfactory results can be obtaind by the use of a light source provided with a filter absorbing the wavelength region of up to 370 nm as described in JP O.P.I. No. 210458/1987 or the use of a UV light source emitting a principal wavelength region of 970 to 420 nm.

The exposure time applicable to the light-sensitive material of the invention not only ranges from 1 millisecond to 1 minute usable in ordinary cameras but also may be shorter than 1 microsecond, such as 100 nanosecond–1 microsecond exposure by using a cathode-ray tube or xenon flash tube. It is also possible to give the light-sensitive material a longer exposure than 1 second. The above exposure may be made either continuously or intermittently.

The invention may apply to various light-sensitive materials such as graphic arts films, X-ray films, negative films for general use, reversal films for general use, positive films for general use and direct positive films; but it can provide remarkable effects when applied to light-sensitive materials for graphic arts use.

In the invention, the light-sensitive material may, when processed, be subjected to various developments such as black-and-white and reversal developments according to known methods.

In the invention, the fixing solution used may contain a thiosulfate, a sulfite, and various others including an acid, a salt, a fixing accelerater, a lubricant, a surfactant, a chelating agent and a hardener; examples thereof include potassium, sodium and ammonium salts of thiosulfate and sulfite, acids including sulfuric acid, hydrochloric acid, nitric acid, boric acid, formic acid, acetic acid, propionic acid, oxalic acid, succinic acid, citric acid, malic acid and phthalic acid, and salts including potassium salts, sodium salts and ammonium salts of these acids. Examples of the above fixing accelerater include the thiourea derivatives and alcohols having a triple bond inside the molecule thereof described in JP E.P. No. 35754/1970, JP O.P.I. Nos. 122535/1983 and 122536/1983, and the thioether, cyclodextran-ether making anion free, crown ethers, diazabicycloundecene and di(hydroxyethyl)butamine described in U.S. Pat. No. 4,126,459. The lubrican includes alkanolamine and alkylene glycol. The chelating agent includes nitrilotriacetic acid and aminoacetic acid such as EDTA. The hardener includes chrome alum, potassium alum and other Al compounds.

The fixing solution in the invention, in order to increase the hardenability of the light-sensitive material, contains preferably an Al compound, and the Al compound content of the fixing solution is preferably 0.1 to 3 g in Al equivalent per liter of the solution.

The sulfite concentration in the fixing solution is preferably 0.03 to 0.4 mol/liter, and more preferably 0.04 to 0.3 mol/liter.

The fixing solution has a pH of preferably 3.9 to 6.5, and most preferably 4.2 to 5.3, under which condition the fixing solution can not only provide satisfactory photographic characteristics.

EXAMPLES

EXAMPLE 1

Preparation of Emulsion A

The following Solutions A, B and C were used to prepare a silver chlorobromide emulsion.

| | |
|---|---|
| <Solution A> | |
| Osein gelatin | 17 g |
| Sodium polyisopropylene-polyethyleneoxy-disuccinate, 10% ethanol solution | 5 ml |
| Distilled water | 1280 ml |
| <Solution B> | |
| Silver nitrate | 170 g |
| Distilled water | 410 ml |
| <Solution C> | |
| Sodium chloride | 45.0 g |
| Potassium bromide | 27.4 g |
| Rhodium trichloride, trihydrate | 28 μg |
| Sodium polyisopropylene-polyethyleneoxy-disuccinate, 10% ethanol solution | 3 ml |
| Osein gelatin | 11 g |
| Distilled water | 407 ml |

After keeping Solution A at 40° C., sodium chloride was added thereto so as that the solution has a EAg value of 160 mV. Next, a mixing stirrer as described in JP O.P.I. Nos. 92523/1982 and 92524/1982 was used to add Solutions B and C in a double-jet process. The addition was carried out with the adding flow being increased gradually during the whole adding time of 80 minutes as shown in Table 1 and with the solution's EAg value being kept constant.

The EAg value was changed from 160 mV to 120 mV 5 minutes after starting the addition by using 3 ml/liter of a sodium chloride aqueous solution, and thereafter this value was maintained until completion of the mixing. In order to keep the EAg value constant, the control therefor was made by using an aqueous solution of silver chloride in concentration of 3 mols/liter.

TABLE 1

| Adding time (min.) | Solution B (ml/min) | Solution C (ml/min) |
|---|---|---|
| 0 | 1.13 | 1.11 |
| 10 | 1.13 | 1.11 |
| 20 | 2.03 | 1.99 |
| 30 | 3.17 | 3.11 |
| 40 | 4.57 | 4.48 |
| 50 | 6.22 | 6.10 |
| 60 | 8.13 | 7.97 |
| 70 | 10.29 | 10.01 |
| 80 | 12.74 | 12.49 |

For measuring the EAg value, a metallic silver electrode and double-junction-type saturated Ag/AgCl comparative electrode (of a structure according to the double-junction disclosed in JP O.P.I. No. 197534/1982) were used. For the addition of Solutions B and C a flow-variable-type roller tube constant flow valve was used. During the addition, emulsion sampling was made to confirm by electron-microscopic observation that no further generation of new grains occurs inside the system. Also during the addition, an aqueous 3% silver nitrate solution was used to keep the system's pH 3.0 constant.

Upon completion of the addition of Solutions B and C, the emulsion was subjected to Ostwald ripening; desalted and washed in the usual manner; and 600 ml of an aqueous osein gelatin solution (containing 30 g of osein gelatin) were added thereto and the liquid was dispersed by stirring for 30 minutes at 55° C.; and then the whole quantity was made 750 ml, whereby Emulsion A was prepared.

The Emulsion A was subjected to gold-sulfur sensitization; potassium bromide was added to the emulsion in an amount of 500 mg per mol of silver halide; the following sensitizing dye A was added in an amount of 300mg per mol of silver halide; after a ten-minute interval, 4-hydroxy-6-methyl-1,3,3a,7-tetrazaindene as a stabilizer was added; and then the following sensitizing dye B was added in an amount of 100 mg per mol of the silver halide contained in the emulsion.

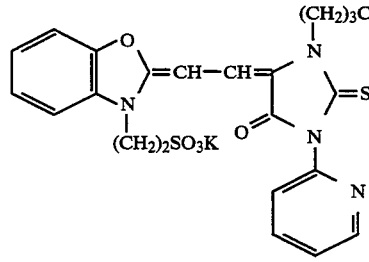

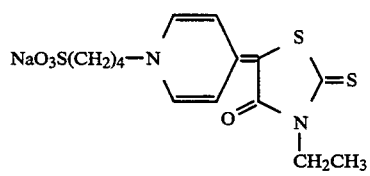

Next, a protective layer to which were added 700 ml/mol Ag of tetrazolium compound T-6 represented by Formula T, 300 mg of sodium p-dodecylbenzenesulfonate and 80 mg/mol Ag of 5-nitroindazole was coated according to double-jet process, and this was designated as Sample (1). Also, a protective layer, to which 5-nitrosoindazole and 2.5 g per mol of Ag of cyclodextrin Isoelite P, produced by Ensuikoseito Co., were added, was coated also according to double-jet process. This was designated as Sample (2).

Each of the obtained samples was allowed to stand for 20 days under conditions of 25° C./50% RH, and then divided and exposed through a wedge to a tungsten light. The exposed samples each were processed in the following developer and fixer solutions by using an automatic processor.

| <Processing conditions> | | |
|---|---|---|
| Process | Temperature | Time |
| Developing | 28° C. | 30 seconds |
| Fixing | 28° C. | 20 seconds |
| Washing | Room temperature | 20 seconds |
| Drying | 50° C. | 15 seconds |

| Developer (1) | |
|---|---|
| Composition A | |
| Pure water | 150 ml |
| EDTA-2Na | 2 g |
| Diethylene glycol | 50 g |
| $K_2SO_3$ (55% w/w aqueous solution) | 100 ml |
| $K_2CO_3$ | 50 g |
| Hydroquinone | 15 g |
| 5-Methylbenzotriazole | 200 mg |
| 1-Phenyl--mercaptotetrazole | 30 mg |
| KOH | for adjusting pH to 10.4 |
| KBr | 4.5 g |
| Composition B | |
| Pure water | 3 ml |
| Diethylene glycol | 50 g |
| EDTA-ZNa | 25 mg |
| 5-Nitroindazole | 110 mg |
| 1-Phenyl-3-pyrazolidone | 700 mg |

When using the developer, the above Compositions A and B were dissolved in the order given in 500 ml of water, and then water was added to make the whole quantity was made 1 liter.

| Developer (2) | |
|---|---|
| Composition A | |
| Pure water | 150 ml |
| EDTA-2Na | 2 g |
| $K_2SO_3$(55% w/w aqueous solution) | 100 ml |
| $K_2CO_3$ | 50 g |
| Hydroquinone | 15 g |
| 5-Methylbenzotriazole | 200 mg |
| 1-Phenyl-5-mercaptotetrazole | 30 mg |
| KOH | for adjusting pH to 10.4 |
| KBr | 4.5 g |
| Composition B | |
| Pure water | 20 ml |
| EDTA-2Na | 25 mg |
| 1-Phenyl-3-pyrazolidone | 700 mg |

When using the developer, the above Compositions A and B were dissolved in the order given in 500 ml of water, and water was added to make the whole one liter.

| Developer (3) | |
|---|---|
| Composition A | |
| Pure water | 150 ml |
| EDTA-ZNa | 2 g |
| $K_2SO_3$ (55% w/w aqueous solution) | 100 ml |
| $K_2CO_3$ | 50 g |

-continued

| Developer (3) | |
|---|---|
| Hydroquinone | 15 g |
| 5-Methylbenzotriazole | 200 mg |
| 1-Phenyl-5-mercaptotetrazole | 30 mg |
| KOH | for adjusing pH to 10.4 |
| KBr | 1.5 g |
| Composition B | |
| Pure water | 20 ml |
| 5-Nitroindazole | 0.11 g |
| Cyclodextrin compound | 3.63 g |
| EDTA-2Na | 25 mg |
| 1-Phenyl-3-pyrazolidone | 700 mg |

When using the developer, the above Compositions A and B were dissolved in the order given in 500 ml of water, and then water was added to make the whole one liter.

| Fixing solution (1) | |
|---|---|
| Composition A | |
| Ammonium thiosulfate (72.5% w/w aqueous solution) | 230 ml |
| Sodium sulfite | 9.5 g |
| Sodium acetate, trihydrate | 15.9 g |
| Boric acid | 6.7 g |
| Sodium citrate, dihydrate | 2 g |
| Acetic acid (90% w/v aqueous solution) | 8.1 ml |
| Composition B | |
| Pure water (ion-exchanged) | 17 ml |
| Sulfuric acid (50% w/v aqueous solution) | 5.8 ml |
| Aluminum sulfate ($Al_2O_3$ equivalent 8.1% w/v aqueous solution) | 26.5 g |

When using the developer, the above Compositions A and B were dissolved in the order given in 500 ml of water, and then water was added to make the whole one liter.

The above processed Samples (1) and (2) were evaluated, and the results obtained are shown in Table 2.

The sensitivity is expressed in terms of the log E value of an exposure required to give a density of 2.0, and in the table the sensitivity of each sample is shown in a value relative to that of Sample (1) set at 100.

The fog is given in terms of the minimum density of each film that was processed without being exposed.

In the table, Dmax represents the maximum density of each processed sample. The sharpness is an evaluation made, taking into account the fringe and smoothness of characters, on the image obtained by processing each sample that was exposed by using a process camera, manufactured by Dai-Nippon Screen Co., to photograph documents bearing Class 7 Ming type chinese characters and Class 7 Gothic type faces; wherein the sharpness ranked 5 . . . on a very satisfactory level, ranked 3 . . . on the lowest level among those acceptable, and ranked 4 and 5 . . . on medium levels.

TABLE 2

| Experiment No. | Sample No. | Developer | Relative speed | Fog | Dmax | Sharpness |
|---|---|---|---|---|---|---|
| 1-1 (comp.) | (1) | (1) | 100 | 0.04 | 5.8 | 3 |
| 1-2 (comp.) | (1) | (2) | 110 | 0.08 | 5.8 | 3 |
| 1-3 (Inv.) | (1) | (3) | 100 | 0.04 | 5.8 | 4 |
| 1-4 (Inv.) | (2) | (1) | 105 | 0.03 | 5.8 | 5 |
| 1-5 (Inv.) | (2) | (2) | 100 | 0.04 | 5.9 | 4 |

TABLE 2-continued

| Experiment No. | Sample No. | Developer | Relative speed | Fog | Dmax | Sharpness |
|---|---|---|---|---|---|---|
| 1-6 (Inv.) | (2) | (3) | 100 | 0.03 | 5.9 | 5 |

As is apparent from the above table, when Sample 1 is processed in the known Developer (1), containing diethylene glycol as a solvent for dissolving and preventing 5-nitroindazole from depositing, satisfactory photographic characteristics can be obtained, whereas when the same sample is processed in Developer (2) free of diethylene glycol and 5-nitroindazole, it forms low-contrast images, can not exhibit antifogging effect, and deteriorates sharpness.

The processing in developer (3), in which nitroindazole is not contained, also enables to obtain satisfactory photographic characteristics.

The use of the cyclodextrin in the protective layer of a silver halide light-sensitive material as in Sample 2 enables Developer (2) to obtain satisfactory photographic characteristics.

EXAMPLE 2

Preparation of Emulsion

A silver sulfate solution and a solution obtained by adding a rhodium hexachloride complex salt in an amount of $8\times10^{-5}$ mol/mol Ag to a sodium chloride/potassium bromide solution were added simultaneously with their flow rate being controlled to a gelatin solution, and the produced emulsion was desalted, whereby a monodisperse silver chlorobromide emulsion having a grain size of 0.1 μm and containing 1 mol % silver bromide was obtained.

The above emulsion was subjected to sulfur sensitization in the usual manner, and to the emulsion were added a stabilizer 6-methyl-4-hydroxy-1,3,3a,7-tetrazaindene and the following additives to thereby prepare an emulsion coating liquids E-1 to E-14. Subsequently, an emulsion protective layer coating liquid P-O, a backing layer coating liquid B-O and a backing protective layer coating liquid BP-O, comprising the following compositions, were prepared.

| Emulsion coating liquid E-1 | |
|---|---|
| Compound (a) | 1 mg/m$^2$ |
| NaOH (0.5N) | for adjusting pH to 5.6 |
| Compound (b) | 40 mg/m$^2$ |
| Compound (c) | 30 mg/m$^2$ |
| Saponin (20%) | 0.5 cc/m$^2$ |
| Sodium dodecylbenzxenesulfonate | 20 mg/m$^2$ |
| 5-Methylbenzotriazole | 10 mg/m$^2$ |
| Compound (d) | 2 mg/m$^2$ |
| Compound (e) | 10 mg/m$^2$ |
| Compound (f) | 6 mg/m$^2$ |
| Styrene-maleic acid copolymerized aqueous polymer (thickener) | 90 mg/m$^2$ |

(a) A mixture of

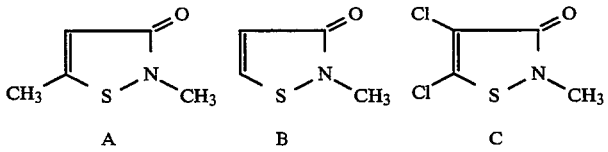

A:B:C = 50:46:4

(b)

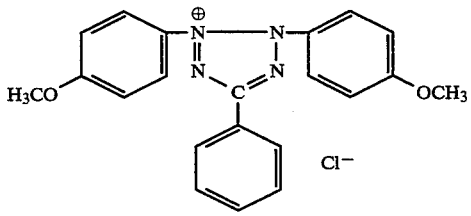

(c)

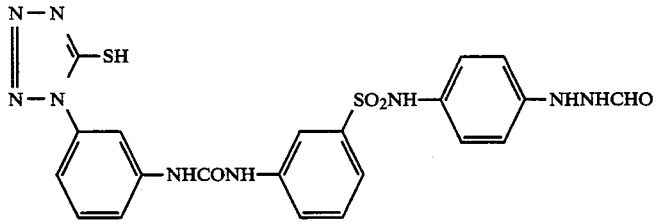

(d)

-continued

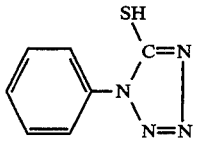

(e)

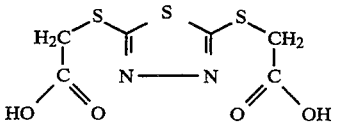

(f)

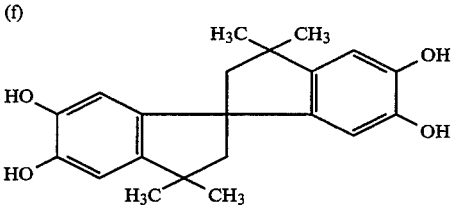

| | |
|---|---|
| Emulsion protective layer coating liquid P-O | |
| Gelatin | 0.5 g/m$^2$ |
| Compound (g) (1%) | 25 ml/m$^2$ |
| Compound (h) | 120 mg/m$^2$ |
| 5-Nitroindazole | 10 mg/m$^2$ |
| Spherical monodisperse silica (8 μm) | 20 mg/m$^2$ |
| Spherical monodisperse silica (3 μm) | 10 mg/m$^2$ |
| Compound (i) | 100 mg/m$^2$ |
| Citric acid | for adjusting pH to 6.0 |
| Backing layer coating liquid B-O | |
| Gelatin | 1.0 g/m$^2$ |
| Compound (j) | 100 mg/m$^2$ |
| Compound (k) | 18 mg/m$^2$ |
| Compound (l) | 100 mg/m$^2$ |
| Saponin (20%) | 0.6 ml/m$^2$ |
| Latex (m) | 300 mg/m$^2$ |
| 5-Nitroindazole | 20 mg/m$^2$ |
| Styrene-maleic acid copolymerized aqueous polymer (thickener) | 45 mg/m$^2$ |
| Glyoxal | 4 mg/m$^2$ |
| Compound (o) | 100 mg/m$^2$ |
| Backing protective layer coating liquid BP-O | |
| Gelatin | 0.5 g/m$^2$ |
| Compound (g) (1%) | 2 ml/m$^2$ |
| Spherical polymethyl methacrylate (4 μm) | 25 mg/m$^2$ |
| Sodium chloride | 70 mg/m$^2$ |
| Glyoxal | 22 mg/m$^2$ |
| Compound (n) | 10 mg/m$^2$ |

(g)

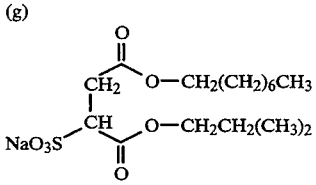

(h)

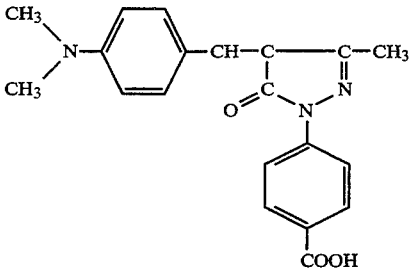

(solid disperse dye)

(i)

-continued
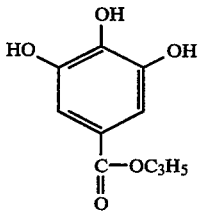
(j)
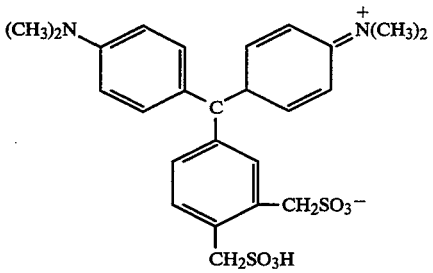
(k)
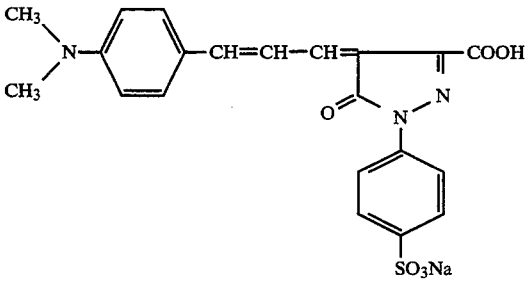
(l)
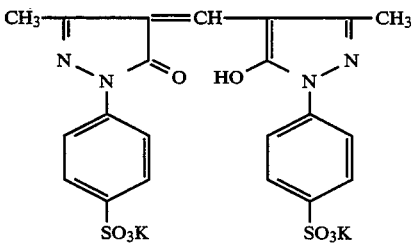
(m)
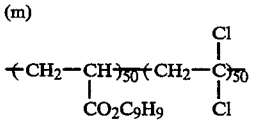
(n)
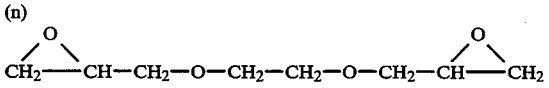
(o)
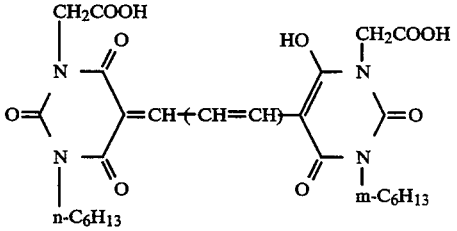
Dissolved in a concentration of 5% in a NaOH aqueous solution at pH 12, and the pH is lowered to 6 by use of acetic acid.

Each coating liquid prepared above, after adding the following additives thereto, was coated by using a roll fit coating pan and air knife on a 100 μm-thick polyethylene terephthalate base subbed as described in JP O.P.I. No. 19941/1984 and subjected to 10 W/m$^2$.min corona discharge treatment. The coated film was dried under conditions of an overall coefficient of heat transfer of 25 Kcal(m$^2$.hr.° C.) for 30 minutes at 90° C., and then for 90 seconds at 140° C. After the drying, the coated layer had a thickness of 1 μm and a surface resistivity of $1\times10^5$ Ω at 23° C./55%.

Water-soluble polymer 70 g/liter

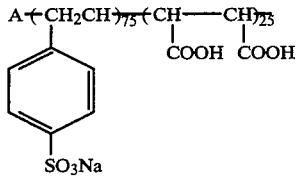

$\overline{Mn}$ = 5000

Hydrophobic polymer particles 40 g/liter

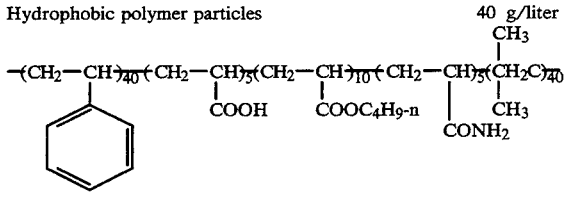

Ammonium sulfate 0.5 g/liter
Polyethylene oxide compound 6 g/liter
(average molecular weight: 600)
Hardening agent 12 g/liter
a mixture of

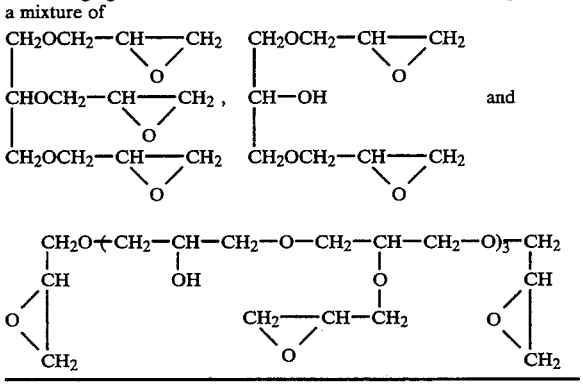

On the above base were coated an emulsion layer and an emulsion protective layer in the described order from the support side in accordance with double-jet process with a hardener solution being added thereto by a slide hopper process. After the coated layers were set by passing the film through a cooling-air setting zone at 5° C., on the film were further coated a backing layer and a backing protective layer with a hardener solution being added by slide hopper, and then set by cooling air at 5° C. At the points of time when the coated film passes the respective setting zones, the coated liquids appeared sufficiently set. Subsequently, both sides of the film were dried at the same time under the following conditions. After the backing coating, the film was transported in the state of not in contact with rollers and others until it is taken up. The coating speed employed was 100 m/min.

<Latex synthesis method Lx-1>

Another example of the preparation of latex is as follows: 1.25 kg of gelatin, 0.05 kg of ammonium persulfate and 7.5 g of dodecylbenzenesulfonate were added to 40 liters of water, and to the solution, with stirring at 50° C., was added a mixture of the following monomers (a) to (d) spending one hour in a nitrogen atmosphere with stirring for 3 hours; after that, 0.05 kg of ammonium persulfate was added and the liquid was further stirred for 1.5 hours; upon completion of the reaction, the residual monomers were removed by one hour of steam distillation; the liquid was cooled to room temperature, and its pH was adjusted to 6.0 with ammonia water; and then water was added to make the whole 80.5 Kg.

| | |
|---|---|
| (a) Ethyl acrylate | 5.0 kg |
| (b) Methyl methacrylate | 1.4 kg |
| (c) Styrene | 3.0 kg |
| (d) Sodium acrylamido-2-methylpropanesulfonate | 0.6 kg |

The above same latex was added in an amount of 0.5 g/m$^2$ to each of both the emulsion layer and the emulsion protective layer.

A sample was prepared in the same manner as in Example 1, using an emulsion protecting layer coating liquid P-O containing the same 5-nitroindazole in the same amount as in the emulsion protecting layer coating liquid P-O of Sample (1) of Example 1, and was designated as Sample (3); and a sample in which Isoelite P, a cyclodextrin compound, was added to the protective layer so that the amount thereof be 20 mg/m$^2$ was prepared and designated as Sample (4).

The above prepared samples were processed by use of the Developers (1) to (3) of Example 1. Experiments were made in the following manner: Each of Samples (3) and (4), with its emulsion side in contact with an original, was image-wise exposed by means of a light-room printer P627FM equipped with a no-electrode discharge tube light source, manufactured by Fusion Corp. in the U.S., and after that, Samples and (4) were processed under the same conditions as in Example 1. The results are shown in Table 3.

TABLE 3

| Experiment No. | Sample No. | Developer No. | γ | Negative-appearance letter image quality |
|---|---|---|---|---|
| 2-1 (Comp.) | (3) | (1) | 4.0 | 3.5 |
| 2-2 (Comp.) | (3) | (2) | 3.5 | 2.5 |
| 2-3 (Inv.) | (3) | (3) | 4.5 | 4.5 |
| 2-4 (Inv.) | (4) | (1) | 4.0 | 5.0 |
| 2-5 (Inv.) | (4) | (2) | 4.5 | 4.5 |
| 2-6 (Inv.) | (4) | (3) | 4.5 | 5.0 |

In Table 3, the evaluations were made as follows:

$$\gamma=(1.0-0.1)/\{\log(\text{exposure giving a density of } 1.0)-\log(\text{exposure giving a density of } 0.1)\}$$

Negative-appearance Letter Image Quality

The negative-appearance letter quality is classified into 5 grades, wherein Grade 5 means a highly excellent image quality which, when a light-sensitive material is properly exposed so that a 50% halftone dot area can be reproduced as it is thereon, is capable of reproducing 30 μm-size letters, while Grade 1 is a quality which, when given a proper exposure, can reproduce only letters of 150 μm size or larger; i.e., unacceptable quality. Those of Grades 3 and above are on the usable level.

Thus, according to the invention, it is apparent that the processing of a light-sensitive material can be carried out without using any solvent even in the presence of a water-less-soluble material such as an antifoggant, and the invention enables the obtaining of photographic characteristics satisfactory in respect of the sensitivity, fog and sharpness.

Therefore, the developer solution can be free of any organic solvent, thereby increasing the degree of freedom of composing a developer solution, being useful for environment, and enabling to provide a processing chemicals easy to use, i.e., a concentrated developer solution.

EXAMPLE 3

Preparation of Emulsion B

A silver iodobromide emulsion (containing silver iodide 2 mol % per mol of silver) was prepared by using a double-jet process. In this process $K_2IrCl_6$ was added in an amount of $8\times10^{-7}$ mol per mol of silver. The obtained emulsion was a cubic monodisperse emulsion having an average grain size of 0.20 μm (grain size distribution's variation coefficient: 9%). The emulsion was washed and desalted in the usual manner. After the desalting, the emulsion had pAg of 8.0 at 40° C. Subsequently to the emulsion were added the following sensitizing dyes D-1 and D-2 in amounts of 200 mg and 10 mg, respectively, per mol of silver, and also was added a mixture of the following Compounds A, B and C, and after that, the emulsion was subjected to sulfur sensitization, whereby Emulsion B was obtained.

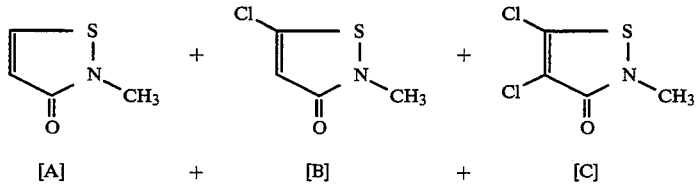

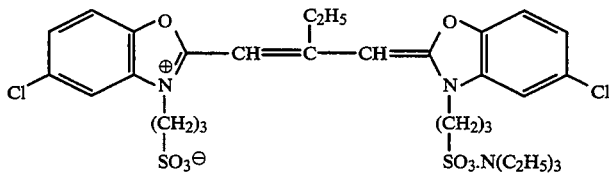

Sensitizing dye D-1

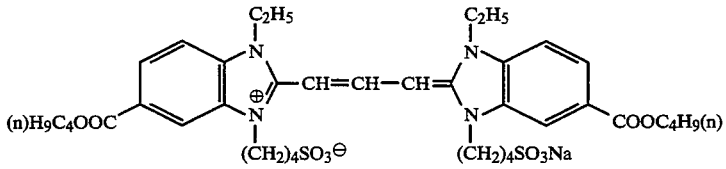

Sensitizing dye D-2

Preparation of a Silver Halide Photographic Light-sensitive Material

On one side of a subbed polyethylene terephthalate support was coated a light-sensitive silver halide emulsion layer according to the following prescription (1) so as to have a gelatin coating weight of 2.0 g/m² and a silver coating weight of 3.2 g/m², and on the emulsion layer further coated an emulsion protective layer of the following prescription (2) so as to have a gelatin coating weight of 1.0 g/m². And on the opposite side (subbed) of the support to the emulsion layer was coated a backing layer according to the following prescription (3) so as to have a gelatin coating weight of 2.4 g/m², and further on the backing layer was coated a backing protective layer of the following prescription (4) so as to have a gelatin coating weight of 1 g/m².

In the above, sodium carbonate and/or citric acid were used to adjust pH of each layer and also pH of the outermost layer, whereby the light-sensitive materials (5) to (8) as shown in Table 4 were obtained.

| Prescription (1) (Emulsion layer composition) | |
|---|---|
| Gelatin | 2.0 g/m² |
| Silver halide emulsion B, silver equivalent | 3.2 g/m² |
| Stabilizer: 4-methyl-6-hydroxy-1,3,3a,7-tetrazaindene | 30 mg/m² |
| Antifoggant: | |
| 5-nitroindazole | 10 mg/m² |
| 1-phenyl-5-mercaptotetrazole | 5 mg/m² |
| Surfactant: Sodium dodecylbenzenesulfonate | 0.1 g/m² |
| Surfactant: S-1 | 8 mg/m² |

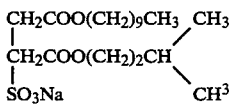

| Hydrazine derivative-α-cyclodextrin clathrate compound: | |
|---|---|
| hydrazine derivative | $7\times10^{-5}$ mol/m² |
| α-cyclodextrin | $1\times10^{-4}$ mol/m² |
| Latex polymer: | 1 g/m² |

-continued $$\left[CH_2-\underset{\underset{COOC_4H_9}{|}}{CH}\right]_m\left[CH_2-\underset{\underset{OCOCH_3}{|}}{CH}\right]_n \quad m:n = 50:50$$

| | |
|---|---|
| Polyethylene glycol, molecular weight: 4000 | 0.1 g/m$^2$ |
| Hardener: HA-1 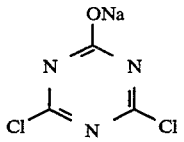 | 60 mg/m$^2$ |

Prescription (2) (Emulsion protective layer composition)

| | |
|---|---|
| Gelatin | 0.9 g/m$^2$ |
| Surfactant: S-2 $CH_2COOCH_2(C_2H_5)C_4H_9$ \| $CHCOOCH_2CH(C_2H_5)C_4H_9$ \| $SO_3Na$ | 10 g/m$^2$ |
| Surfactant: S-3 $NaO_3S-CHCOOCH_2(CF_2)_6H$ \| $CH_2COOCH_2(CF_2)_6H$ | 10 mg/m$^2$ |
| Matting agent: monodisperse silica having an average grain size of 3.5 μm | 3 mg/m$^3$ |
| Hardener: 1,3-vinylsulfonyl-2-propanol | 40 mg/m$^2$ |

Prescription (3) (Backing layer composition)

| | |
|---|---|
| 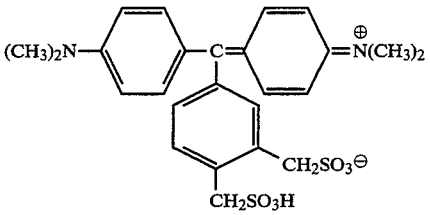 | 30 mg/m$^2$ |
| 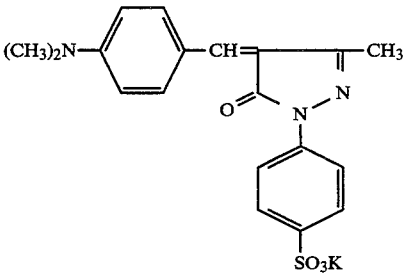 | 75 mg/m$^2$ |
| 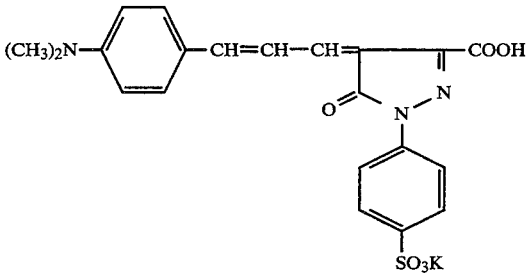 | 30 mg/m$^2$ |
| Gelatin | 2.4 g/m$^2$ |
| Surfactant: sodium dodecylbenzenesulfonate | 0.1 g/m$^2$ |
| Surfactant: S-1 | 6 mg/m$^2$ |
| Colloidal silica | 100 mg/m$^2$ |

-continued

| | | |
|---|---|---|
| Hardener: E | 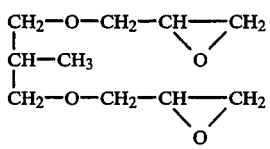 | 55 mg/m$^2$ |

Prescription (4) (Backing protective layer composition)

| | |
|---|---|
| Gelatin | 1 g/m$^2$ |
| Matting agent: monodisperse polymethyl methacrylate having an average particle size of 5.0 μm | 50 mg/m$^2$ |
| Surfactant: S-2 | 10 mg/m$^2$ |
| Hardener: glyoxal | 25 mg/m$^2$ |
| Hardener: HA-1 | 35 mg/m$^2$ |

Light-sensitive material samples (1) to (4) were prepared in the same manner as in the light-sensitive material samples (5) to (8) except that the hydrazine derivative/α-cyclodextrin clathrate compound in the foregoing Prescrition (1) was replaced by the hydrazine derivative shown in Table 4.

The light-sensitive material Samples (1) to (8) were allowed to stand for 24 hours at 23° C./50% RH, and then hermetically sealed for storage (Storage I) in a 3-day incubation treatment at a temperature of 55° C. (Storage II). Each of the light-sensitive material samples subjected to the above two different Storages I and II was exposed through a stepwedge in contact therewith to a 3200K tungsten light for 5 seconds, and then processed in developer and fixing solutions having the following compositions loaded in an automatic rapid processor GR-26SR, manufactured by KONICA Corp., wherein the processing conditions employed are as follows:

Developer (4)

| | |
|---|---|
| Sodium hydrogensulfite | 40 g |
| N-methyl-p-aminophenol sulfate | 350 mg |
| Disodium ethylenediaminetetraacetate | 1 g |
| Sodium chloride | 5 g |
| Potassium chloride | 1.2 g |
| Trisodium phosphate | 75 g |
| 5-Methylbenzotriazole | 250 mg |
| 2-Mercaptobenzothiazole | 23 mg |
| Benzotriazole | 83 mg |
| Hydroquinone | 29 g |
| Diisopropylaminophenol | 2.3 ml |
| Amine compound Am-1 | 0.5 ml |
| Potassium hydroxide | for adjusting pH to 11.6 |
| Water to make 1 liter | |

Amine compound Am-1

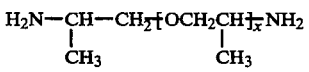

x = 2.6 (average)

Fixing solution (2)

| | |
|---|---|
| Ammonium thiosulfate (59.5% w/v aqueous sol.) | 830 ml |

-continued

| | |
|---|---|
| Disodium ethylenediaminetetraacetate | 515 mg |
| Sodium sulfite | 63 g |
| Boric acid | 22.5 g |
| Acetic acid (90% w/v aqueous solution) | 82 g |
| Citric acid (50% w/v aqueous solution | 15.7 g |
| Gluconic acid (50% w/w aqueous solution) | 13 ml |
| Glutaraldehyde | 3 g |
| Sulfuric acid | for adjusting pH to 4.6 |
| Water to make 1 liter. | |

Processing conditions

| Step | Temperature | Time |
|---|---|---|
| Developing | 38° C. | 20 seconds |
| Fixing | 38° C. | 20 seconds |
| Washing | Normal temperature | 15 seconds |
| Drying | 40° C. | 15 seconds |

Above each processing time includes the time necessary for cross-over transport to the subsequent step.

Each processed sample was measured with respect to its density by use of an optical densitometer KONICA PDA-65 to obtain its sensitivity from an exposure required to give a density of 2.5, and each sample's sensitivity is shown in the following table in terms of a relative speed to that of Sample No. 1 set at 100. Further, the gamma value of each sample is expressed in terms of tangent between the densities of 0.1 and 2.5. A gamma value of less than 6 is totally unacceptable; that of not less than 6.0 and less than 10 is still insufficient contrast, and a super-high-contrast image having as much high a gamma value as 10 or more is enough for practical use.

Black spots in the unexposed area of each sample were visually examined for evaluation by use of a 40-power magnifying glass. Samples having no black spots at all was evaluated to be of the highest rank 50 whereas those having black spots were ranked down as 4, 3, 2 to 1 according to the degree of their appearance, wherein if ranked 3.5, it represents a medium grade between 3 and 4. Those ranked 1 and 2 are suitable for practical use.

The results are shown in Table 4.

TABLE 4

| Experiment No. | Sample No. | Hydrazine derivative | Developer prescription No. | Storage I Gamma value | Storage I Black spots | Storage II Gamma value | Storage II Black spots |
|---|---|---|---|---|---|---|---|
| 3-1 (Comp.) | (1) | H-5 | (4) | 10.5 | 3 | 8.0 | 2 |
| 3-2 (Comp.) | (2) | H-6 | (4) | 10.0 | 2.5 | 4.9 | 1 |
| 3-3 (Comp.) | (3) | H-7 | (4) | 10.5 | 3 | 6.3 | 2 |
| 3-4 (Comp.) | (4) | H'-3 | (4) | 10.0 | 2 | 7.0 | 2 |
| 3-5 (Inv.) | (5) | H-6 | (4) | 12.0 | 4 | 10.9 | 4 |
| 3-6 (Inv.) | (6) | H-7 | (4) | 12.0 | 4.5 | 11.0 | 4.5 |
| 3-7 (Inv.) | (7) | H'-3 | (4) | 11.5 | 4 | 10.5 | 4 |

TABLE 4-continued

| Experiment No. | Sample No. | Hydrazine derivative | Developer prescription No. | Storage I Gamma value | Storage I Black spots | Storage II Gamma value | Storage II Black spots |
|---|---|---|---|---|---|---|---|
| 3-8 (Inv.) | (8) | H-22 | (4) | 11.5 | 4.5 | 10.8 | 4 |

As is apparent from Table 4, the coexistence of a hydrazine derivative and cyclodextrin in the form of a clathrate compound within the silver halide emulsion layer of a silver halide photographic light-sensitive material enables to markedly restrain the light-sensitive material's image contrast deterioration and black spots occurring with passage of time.

EXAMPLE 4

Light-sensitive material Samples (9) to (12) were prepared in the same manner as in the foregoing Samples (1) to (4) except that the Sensitizing dyes D-1 and D-2 were replaced by the following sensitizing dye D-3 in an amount of 15 mg per mol of silver; the hydrazine derivative/α-cyclodextrin clathrate compound in the foregoing prescription (1) was replaced by the hydrazine derivative given in Table 5; and the addition of $3\times10^{-5}$ mol/m$^2$ of a nuclear formation acceleration compound N-10 was made to the Prescription (1). In addition, light-sensitive material Samples (13) to (16) were prepared in the same manner as in the foregoing Samples (9) to (12) except that the hydrazine derivative for the hydrazine derivative/α-cyclodextrin clathrate compound was replaced as shown in Table 5. These Samples (9) to (16) were processed in the same manner as in Example 3 except that the developer's composition was changed to the following Developer (5) (Experiment Nos.4-1 to 4-8). The results are shown in Table 5.

Sensitizing dye D-3

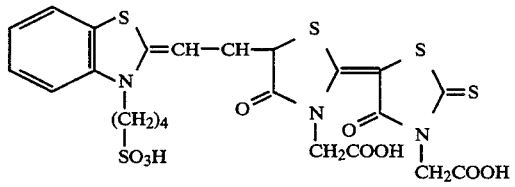

Developer (5)

Composition A

| | |
|---|---|
| Pure water (ion-exchanged) | 150 ml |
| Disodium ethylenediaminetetraacetate | 2 g |
| Ethylene glycol | 50 g |
| Potassium sulfite (55% w/v aqueous solution) | 100 ml |
| Potassium carbonate | 50 g |
| Hydroquinone | 15 g |
| 5-methylbenzotriazole | 200 ml |

-continued

Sensitizing dye D-3

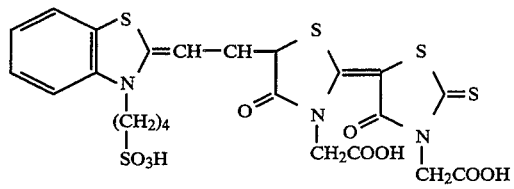

| | |
|---|---|
| 1-Phenyl-5-mercaptotetrazole | 30 mg |
| Potassium hydroxide | for adjusting pH to 10.5 |
| Potassium bromide | 4.5 g |
| Composition B | |
| Pure water (ion-exchanged) | 3 ml |
| Diethylene glycol | 50 g |
| Disodium ethylenediaminetetraacetate | 25 g |
| Acetic acid (90% aqueous solution) | 0.3 ml |
| 5-Nitroindazole | 110 mg |
| 1-Phenyl-3-pyrazolidone | 500 mg |

When using the developer, the above compositions A and B were dissolved in the order given in 500 ml of water, and water was added to make the whole one liter.

TABLE 5

| Experiment No. | Sample No. | Hydrazine derivative | Developer prescription No. | Storage I Gamma value | Storage I Black spots | Storage II Gamma value | Storage II Black spots |
|---|---|---|---|---|---|---|---|
| 4-1 (Comp.) | (9) | H-29 | (5) | 10.0 | 3 | 8.5 | 1 |
| 4-2 (Comp.) | (10) | H-31 | (5) | 8.0 | 3 | 8.0 | 2 |
| 4-3 (Comp.) | (11) | H-38 | (5) | 9.5 | 4 | 8.2 | 2 |
| 4-4 (Comp.) | (12) | H-40 | (5) | 9.0 | 4 | 8.0 | 2 |
| 4-5 (Inv.) | (13) | H-29 | (5) | 12.0 | 3.5 | 10.0 | 3 |
| 4-6 (Inv.) | (14) | H-31 | (5) | 10.0 | 3.5 | 9.2 | 3.5 |
| 4-7 (Inv.) | (15) | H-38 | (5) | 10.5 | 4.5 | 9.2 | 4.5 |
| 4-8 (Inv.) | (16) | H-40 | (5) | 10.5 | 4.5 | 9.5 | 4 |

EXAMPLE 5

Experiments were made in the same manner as in Example 3 except that light-sensitive material Samples (1) to (16) in Examples 3 and 4, and Developers (4) and (5) and the following Developers (6) and (7) were used, and combinations of both were as shown in Tables 6 and 7, and the fixing solution and developing conditions used were as follows. The results are shown in Tables 6 and 7, wherein 'α-CD' stands for α-cyclodextrin.

Developer (6)

| | |
|---|---|
| Sodium ethylenediaminetetraacetate | 1 g |
| Sodium sulfite | 60 g |
| Boric acid | 40 g |
| Hydroquinone | 35 g |
| Sodium hydroxide | 8 g |
| Sodium bromide | 3 g |
| 5-Methylbenzotriazole | 0.2 g |
| 2-Mercaptobenzothiazole | 0.1 g |
| 2-Mercaptobenzothiazole-5-sulfonic acid | 0.2 g |
| 1-Phenyl-4,4-dimethyl-3-pyrazolidone | 0.2 g |
| α-cyclodextrin | 7 g |
| Water to make 1 liter. | |
| Adjust pH to 10.8 with sodium hydroxide. | |

Developer (7)

-continued

| | |
|---|---|
| Sodium hydrogensulfite | 40 g |
| N-methyl-p-aminophenol-sulfate | 350 mg |
| Disodium ethylenediaminetetraacetate | 1 g |
| Sodium chloride | 5 g |
| Potassium bromide | 1.2 g |
| Tripotassium phosphate, dodecahydrate | 27 g |
| Potassium phosphate | 20 g |
| 5-Methylbenzotriazole | 250 mg |
| 2-mercaptobenzothiazole | 23 mg |
| Benzotriazole | 83 mg |
| Hydroquinone | 29 g |
| Diisopropylaminophenol | 2.3 ml |
| Amine compound Am-1 | 0.5 ml |
| α-cyclodextrin | 7.0 g |
| Potassium hydroxide | for adjusting pH to 11.6 |
| Water to make one liter. | |

TABLE 6

| Experiment No. | Light-sensitive material No. | Hydrazine derivative | Cyclo-dextrin | Developer No. | Cyclo-dextrin | Storage I Gama value | Storage I Black spots | Storage II Gama value | Storage II Black spots |
|---|---|---|---|---|---|---|---|---|---|
| 5-1 (Inv.) | (1) | H-5 | — | (7) | α-CD | 10.5 | 3.5 | 8.5 | 3 |
| 5-2 (Inv.) | (2) | H-6 | — | (7) | α-CD | 10.5 | 3.5 | 6.0 | 3.5 |
| 5-3 (Inv.) | (3) | H-7 | — | (7) | α-CD | 10.8 | 3.5 | 6.5 | 3.5 |
| 5-4 (Inv.) | (4) | H'-3 | — | (7) | α-CD | 10.8 | 3.5 | 7.5 | 3 |
| 5-5 (Comp.) | (1) | H-5 | — | (4) | — | 10.5 | 3 | 8.0 | 2 |
| 5-6 (Comp.) | (2) | H-6 | — | (4) | — | 10.0 | 2.5 | 4.9 | 1 |
| 5-7 (Comp.) | (3) | H-7 | — | (4) | — | 10.5 | 3 | 6.3 | 2 |
| 5-8 (Comp.) | (4) | H'-3 | — | (4) | — | 10.0 | 2 | 7.0 | 2 |
| 5-9 (Inv.) | (5) | H-6 | α-CD | (7) | α-CD | 12.5 | 4 | 11.0 | 4.5 |
| 5-10 (Inv.) | (6) | H-7 | α-CD | (7) | α-CD | 12.5 | 4.5 | 11.0 | 5 |
| 5-11 (Inv.) | (7) | H'-3 | α-CD | (7) | α-CD | 11.8 | 4 | 10.8 | 4.5 |
| 5-12 (Inv.) | (8) | H-22 | α-CD | (7) | α-CD | 12.0 | 4.5 | 11.0 | 4.5 |

TABLE 7

| Experiment No. | Light-sensitive material No. | Hydrazine derivative | Cyclo-dextrin | Developer No. | Cyclo-dextrin | Storage I Gamma value | Storage I Black spots | Storage II Gamma value | Storage II Black spots |
|---|---|---|---|---|---|---|---|---|---|
| 5-13 (Inv.) | (9) | H-29 | — | (6) | α-CD | 10.5 | 3.5 | 9.0 | 3 |
| 5-14 (Inv.) | (10) | H-31 | — | (6) | α-CD | 8.5 | 3.5 | 8.5 | 3 |
| 5-15 (Inv.) | (11) | H-38 | — | (6) | α-CD | 10.0 | 4.5 | 8.5 | 4 |
| 5-16 (Inv.) | (12) | H-40 | — | (6) | α-CD | 9.5 | 4.5 | 8.5 | 4 |
| 5-17 (Comp.) | (9) | H-29 | — | (5) | — | 10.0 | 3 | 8.5 | 1 |
| 5-18 (Comp.) | (10) | H-31 | — | (5) | — | 8.0 | 3 | 8.0 | 2 |
| 5-19 (Comp.) | (11) | H-38 | — | (5) | — | 9.5 | 4 | 8.2 | 2 |
| 5-20 (Comp.) | (12) | H-40 | — | (5) | — | 9.0 | 4 | 8.0 | 2 |
| 5-21 (Inv.) | (13) | H-29 | α-CD | (6) | α-CD | 12.5 | 3.5 | 10.5 | 4 |
| 5-22 (Inv.) | (14) | H-31 | α-CD | (6) | α-CD | 11.5 | 3.5 | 10.5 | 4 |
| 5-23 (Inv.) | (15) | H-38 | α-CD | (6) | α-CD | 12.0 | 4.5 | 10.5 | 4.5 |
| 5-24 (Inv.) | (16) | H-40 | α-CD | (6) | α-CD | 12.0 | 5 | 10.5 | 4.5 |

From Tables 6 and 7 it is apparent that the effect of the invention can be obtained regardless of whether cyclodextrin is added to the light-sensitive material or to the developer solution.

EXAMPLE 6

Preparation of Silver Halide Emulsion Sample C

A silver iodobromide emulsion (containing silver iodide in 2 mol % per mole of silver) was prepared by use of a double-jet process. In the course of the mixing, $K^2IrCl^6$ in an amount of $8\times10^{-7}$ mol per mol of silver was added. The obtained emulsion was an emulsion comprising cubic monodisperse silver halide grains having an average grain size of 0.20 μm (coefficient of variation: 9%). The emulsion was washed and desalted in the usual manner. pAg of the emulsion at 40° C. after the desalting was 8.0. Subsequently, a potassium iodide aqueous solution in 0.1 mol % per mol of silver was added to the above emulsion to thereby make conversion of the grain surface, and then the foregoing sensitizing dyes D-1 and D-2 in amounts of 200 mg and 10 mg, respectively, per mol of silver, and further the foregoing compounds (A), (B) and (C) were added, whereby Emulsion C was obtained.

Preparation of Silver Halide Light-sensitive Material

On one subbed side of a polyethylene terephthalate support was coated a light-sensitive silver halide emulsion layer of the following prescription (5) so as to have a gelatin coating weight of 2.0 g/m² and a silver coating weight of 3.2 g/m², and further coated thereon an emulsion protective layer of the foregoing prescription (2) so as to have a gelatin coating weight of 1.0 g/m², while on the other subbed side of the support was formed a backing layer of the foregoing prescription (3) so as to have a gelatin coating weight of 2.4 g/m², and further formed thereon a backing protective layer of the foregoing prescription (4) so as to have a gelatin coating weight of 1 g/m².

In the above, sodium carbonate and/or citric acid were used to adjust pH of each layer, and also adjust pH of the outermost layer, whereby light-sensitive material Samples (22) to (26) were prepared as shown in Table 8.

| Prescription (5) (emulsion layer composition) | |
|---|---|
| Gelatin | 2.0 g/m² |
| Silver halide emulsion C, silver equivalent | 3.2 g/m² |
| Stabilizer: 4-methyl-6-hydroxy-1,3,3a,7-tetrazaindene | 30 mg/m² |
| Antifoggant: Adenine | 10 mg/m² |
| Antifoggant: 1-Phenyl-5-mercaptotetrazole | 5 mg/m² |
| Surfactant : Sodium dodecylbenzenesulfonate | 0.1 g/m² |
| Surfactant : S-1 | |
| Clathrate compound comprised of the hydrazine derivative described in Table 8 | |

-continued

| | |
|---|---|
| and Isoelite P (tradename, branched-chain-type cyclodextrin, manufactured by Ensuiko-Seito Co.): | |
| the hydrazine derivative content | $7 \times 10^{-5}$ mol/m$^2$ |
| the Isoelite P | $7 \times 10^{-3}$ mol/m$^2$ |
| Latex polymer Poly-1 (previously mentioned) | 1 g/m$^2$ |
| Polyethylene glycol (molecular weight: 4000) | 0.1 g/m$^2$ |
| Hardener HA-1 (previously mentioned) | 60 mg/m$^2$ |

Light-sensitive material Samples (17) to (21) were prepared in the same manner as in the light-sensitive material Samples (22) to (26) except that the hydrazine derivative in Prescription (5) was incorporated without taking the form of a clathrate compound with Isoelite P.

These light-sensitive material samples were processed in the foregoing Developer (4) and evaluated in the same manner as in Example 3. The results are shown in Table 8.

TABLE 8

| Experiment No. | Light-sensitive material No. | Hydrazine derivative | Storage I Gamma value | Storage I Black spots | Storage II Gamma value | Storage II Black spots |
|---|---|---|---|---|---|---|
| 6-1 (Comp.) | (17) | H-24 | 10 | 2.5 | 7.0 | 2 |
| 6-2 (Comp.) | (18) | H-22 | 10.5 | 3 | 8.0 | 2 |
| 6-3 (Comp.) | (19) | H-6 | 10.0 | 2.5 | 4.9 | 1 |
| 6-4 (Comp.) | (20) | H-7 | 10.5 | 3 | 6.3 | 2 |
| 6-5 (Comp.) | (21) | H-44 | 10 | 2 | 6.9 | 1.5 |
| 6-6 (Inv.) | (22) | H-24 | 12 | 4 | 11.0 | 3.5 |
| 6-7 (Inv.) | (23) | H-22 | 11.5 | 4.5 | 10.9 | 4 |
| 6-8 (Inv.) | (24) | H-6 | 12 | 4 | 11.0 | 4 |
| 6-9 (Inv.) | (25) | H-7 | 12 | 4.5 | 11.0 | 4.5 |
| 6-10 (Inv.) | (26) | H-44 | 11.5 | 4 | 11.0 | 4 |

EXAMPLE 7

Similar samples were prepared in the same manner as in Example 3 except that the sensitizing dyes D-1 and D-2 for the silver halide emulsion A were replaced by the foregoing D-3 in an amount of 150 mg per mol of silver and to the silver halide emulsion layer of Prescription (5) was added a nucleus formation accelerater N-10 in an amount of $3 \times 10^{-5}$ mol/m$^2$. These samples were exposed for $10^{-5}$ second through an optical wedge with an interference filter for 633 nm, and then processed by using a developer according to the foregoing Prescription (5). The results are shown in Table 9.

TABLE 9

| Experiment No. | Light-sensitive material No. | Hydrazine derivative | Storage I Gamma value | Storage I Black spots | Storage II Gamma value | Storage II Black spots |
|---|---|---|---|---|---|---|
| 7-1 (Comp.) | (27) | H-1 | 8.0 | 3 | 8.0 | 2 |
| 7-2 (Comp.) | (28) | H-2 | 8.5 | 3 | 6.0 | 2 |
| 7-3 (Comp.) | (29) | H-3 | 9.0 | 4 | 6.0 | 2 |
| 7-4 (Comp.) | (30) | H-4 | 11 | 3 | 7.0 | 2 |
| 7-5 (Comp.) | (31) | H-5 | 9.5 | 4 | 6.3 | 2 |
| 7-6 (Comp.) | (32) | H-12 | 10 | 3 | 8.5 | 1 |
| 7-7 (Inv.) | (33) | H-1 | 11 | 4 | 10.8 | 4 |
| 7-8 (Inv.) | (34) | H-2 | 11 | 4 | 10.0 | 3.5 |
| 7-9 (Inv.) | (35) | H-3 | 10.5 | 4.5 | 9.8 | 4.5 |
| 7-10 (Inv.) | (36) | H-4 | 12 | 4.5 | 11.0 | 4 |
| 7-11 (Inv.) | (37) | H-5 | 11 | 4.5 | 10 | 4.5 |
| 7-12 (Inv.) | (38) | H-12 | 11 | 4 | 10 | 3.5 |

EXAMPLE 8

Experiments were made by using light-sensitive material Samples (17) to (38) in the same manner as in Example 3 except that developer solutions according to the foregoing Prescriptions (4) and (5) and the following Prescriptions (8) and (9) were used in the combinations with the above light-sensitive materials as given in Tables 7 and 8. The results are shown in Tables 7 and 8.

| Developer prescription (8) | |
|---|---|
| Sodium ethylenediaminetetraacetate | 1 g |
| Sodium sulfite | 60 g |
| Boric acid | 40 g |
| Hydroquinone | 35 g |
| Sodium hydroxide | 8 g |
| Sodium bromide | 3 g |
| 5-Methylbenzotriazole | 0.2 g |
| 2-Mercaptobenzothiazole | 0.1 g |
| 2-Mercaptobezothiazole-5-sulfonic acid | 0.2 g |
| 1-Phenyl-4,4-dimethyl-3-pyrazolidone | 0.2 g |
| Isoelite P | 7 g |
| Water to make one liter | |
| Adjust pH to 10.8 with sodium hydroxide. | |

| Developer prescription (9) | |
|---|---|
| Sodium hydrogensulfite | 40 g |
| N-methyl-p-aminophenol sulfate | 350 mg |
| Disodium ethylenediaminetetraacetate | 1 g |
| Sodium chloride | 5 g |
| Potassium bromide | 1.2 g |
| Tripotassium phosphate, dodecahydrate | 27 g |
| Potassium phosphate | 20 g |
| 5-Methylbenzotriazole | 250 mg |
| 2-Mercaptobenzothiazole | 23 mg |
| Benzotriazole | 83 mg |
| Hydroquinone | 29 g |
| Diisopropylaminoethanol | 2.3 ml |
| Isoelite P | 7 g |
| Amine compound Am-1 (previously mentioned) | 0.5 ml |
| Potassium hydroxide | for adjusting |

-continued

| | |
|---|---|
| | pH to 11.6 |
| Water to make one liter. | |

TABLE 10

| Experiment No. | Light-sensitive material No. | Hydrazine derivative | Developer prescription | Storage I Gamma value | Storage I Black spots | Storage II Gamma value | Storage II Black spots |
|---|---|---|---|---|---|---|---|
| 8-1 (Inv.) | (22) | H-24 | (10) | 11.0 | 4 | 9.0 | 4 |
| 8-2 (Inv.) | (23) | H-22 | (10) | 10.5 | 3.5 | 8.5 | 3 |
| 8-3 (Inv.) | (24) | H-6 | (10) | 10.5 | 3.5 | 6.0 | 3.5 |
| 8-4 (Inv.) | (25) | H-7 | (10) | 10.8 | 3.5 | 6.5 | 3.5 |
| 8-5 (Inv.) | (26) | H-44 | (10) | 10.8 | 3.5 | 7.5 | 3 |
| 8-6 (Comp.) | (17) | H-24 | (4) | 10 | 3 | 7.0 | 2 |
| 8-7 (Comp.) | (18) | H-22 | (4) | 10.5 | 3 | 8.0 | 2 |
| 8-8 (Comp.) | (19) | H-6 | (4) | 10.0 | 2.5 | 4.9 | 1 |
| 8-9 (Comp.) | (20) | H-7 | (4) | 10.5 | 3 | 6.2 | 2 |
| 8-10 (Comp.) | (21) | H-44 | (4) | 10 | 2 | 7.0 | 2 |
| 8-11 (Inv.) | (17) | H-24 | (10) | 11.5 | 4.5 | 11 | 4 |
| 8-12 (Inv.) | (18) | H-22 | (10) | 11 | 3.5 | 10 | 3 |
| 8-13 (Inv.) | (19) | H-6 | (10) | 11 | 4 | 10 | 3.5 |
| 8-14 (Inv.) | (20) | H-7 | (10) | 11 | 4 | 9.5 | 3.5 |
| 8-15 (Inv.) | (21) | H-44 | (10) | 10.9 | 4 | 9.0 | 3 |

TABLE 11

| Experiment No. | Light-sensitive material No. | Hydrazine derivative | Developer prescription | Storage I Gamma value | Storage I Black spots | Storage II Gamma value | Storage II Black spots |
|---|---|---|---|---|---|---|---|
| 8-16 (Inv.) | (33) | H-1 | (9) | 9.5 | 4 | 8.0 | 3.5 |
| 8-17 (Inv.) | (34) | H-2 | (9) | 9.5 | 4 | 8.0 | 4 |
| 8-18 (Inv.) | (35) | H-3 | (9) | 9.5 | 4.5 | 9.0 | 4 |
| 8-19 (Inv.) | (36) | H-4 | (6) | 11.5 | 4 | 10 | 3.5 |
| 8-20 (Inv.) | (37) | H-5 | (6) | 10 | 4.5 | 9.5 | 4 |
| 8-21 (Inv.) | (38) | H-12 | (6) | 10.5 | 4 | 8.5 | 3.5 |
| 8-22 (Comp.) | (27) | H-1 | (5) | 8.0 | 3 | 8.0 | 2 |
| 8-23 (Comp.) | (28) | H-2 | (5) | 8.5 | 3 | 6.0 | 2 |
| 8-24 (Comp.) | (29) | H-3 | (5) | 9.0 | 4 | 6.0 | 2 |
| 8-25 (Comp.) | (30) | H-4 | (5) | 11 | 3 | 7.0 | 2 |
| 8-26 (Comp.) | (31) | H-5 | (5) | 9.5 | 4 | 6.3 | 2 |
| 8-27 (Comp.) | (32) | H-12 | (5) | 10 | 3 | 8.5 | 1 |
| 8-28 (Inv.) | (27) | H-1 | (9) | 10 | 4 | 9.0 | 3.5 |
| 8-29 (Inv.) | (28) | H-21 | (9) | 10 | 4.5 | 9.5 | 4 |
| 8-30 (Inv.) | (29) | H-3 | (9) | 10 | 4.5 | 9.0 | 4 |
| 8-31 (Inv.) | (30) | H-4 | (9) | 11.5 | 4.5 | 10.5 | 4 |
| 8-32 (Inv.) | (31) | H-5 | (9) | 10.5 | 5 | 9.0 | 4 |
| 8-33 (Inv.) | (32) | H-12 | (9) | 11 | 4.5 | 9.5 | 3.5 |

EXAMPLE 9

On one side of a subbed polyethylene terephthalate support was coated a light-sensitive silver halide emulsion layer according to the following Prescription (6) so as to have a gelatin coating weight of 2.0 g/m$^2$ and a silver coating weight of 3.2 g/m$^2$, and further coated thereon an emulsion protective layer of the foregoing Prescription (2) so as to have a gelatin coating weight of 1.0 g/m$^2$, while on the other side (subbed) of the support was coated a backing layer of the foregoing Prescription (3) so as to have a gelatin coating weight of 2.4 g/m$^2$, and further coated thereon a backing protective layer so as to have a gelatin coating weight of 1 g/m$^2$.

In the above, sodium carbonate and/or citric acid was used to adjust pH of each layer and also pH of the outermost layer, whereby light-sensitive material Samples (39) to (44) shown in Table 12 were prepared.

Prescription (6) (Silver halide emulsion Composition)

| | |
|---|---|
| Gelatin | 2.0 g/m$^2$ |
| Silver halide emulsion B (previously mentioned) silver equivalent | 3.2 g/m$^2$ |
| Stabilizer: 4-Methyl-6-hydroxy-1,3,3a,7-tetrazaindene | 30 mg/m$^2$ |
| Antifoggant: | |
| 5-Nitroindazole | 10 mg/m$^2$ |
| 1-Phenyl-5-mercaptotetrazaole | 5 mg/m$^2$ |
| Surfactant: Sodium dodecylbenzenesulfonate | 0.1 mg/m$^2$ |
| Surfactant: S-1 (previously mentioned) | 8 mg/m$^2$ |
| Hydrazine derivative (given in Table 12) | $1 \times 10^{-5}$ mol/m$^2$ |
| Compound of Formula [I] (given in Table 12) | $1 \times 10^{-4}$ mol/m$^2$ |

-continued

| | |
|---|---|
| Latex polymer: 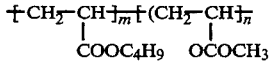 m:n = 50:50 | 1 g/m² |
| Polyethylene glycol, molecular weight: 4000 | 0.1 g/m² |
| Hardener: HA-1 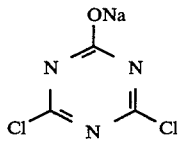 | 60 mg/m² |

Prescription (2) (Emulsion protective layer composition) (previously described)

The above light-sensitive material Samples (39) to (44) were used to carry out experiments in the same manner as in Example 3 except that a developer solution of the foregoing Prescription (4) was used as the developer therefor. The results are shown in Table 12.

TABLE 12

| Experiment No. | Light-sensitive material No. | Compound of Formula [I] | Hydrazine derivative | Storage I Gamma value | Storage I Black spots | Storage II Gamma value | Storage II Black spots |
|---|---|---|---|---|---|---|---|
| 9-1 (Inv.) | (39) | m-1 | H-44 | 12.0 | 4.5 | 11.5 | 4 |
| 9-2 (Inv.) | (40) | m-1 | H-46 | 12.5 | 4.5 | 11.8 | 4.5 |
| 9-3 (Inv.) | (41) | m-1 | H'-1 | 11.0 | 3.5 | 10.2 | 3 |
| 9-4 (Comp.) | (42) | — | H-44 | 10.0 | 3 | 6.7 | 2 |
| 9-5 (Comp.) | (43) | — | H-46 | 10.5 | 3 | 7.0 | 2 |
| 9-6 (Comp.) | (44) | — | H'-1 | 10.0 | 2.5 | 6.5 | 1.5 |

As is apparent from Table 12, the coexistence of the hydrazine derivative and the compound of Formula [I] in the form of a clathrate compound within the emulsion layer of a silver halide photographic light-senisitive material makes it possible to markedly restrain the light-sensitive material's contrast deterioration and black spots occurring with time.

EXAMPLE 10

Six different silver halide light-sensitive material Samples (45) to (50) were prepared in the same manner as in the Samples (39) to (44) of Example 9 except that no compounds of Formula [I] were added.

The light-sensitive material Samples (45) to (50) were used to carry out experiments in the same manner as in Example 3 except that a developer solution of the following Prescription (10) was used in place of that of Example 3.

Developer prescription (10)

-continued

| | |
|---|---|
| Sodium hydrogensulfite | 4 g |
| N-methyl-p-aminophenol sulfate | 350 g |
| Disodium ethylenediaminetetraacetate | 1 g |
| Sodium chloride | 5 g |
| Potassium bromide | 1.2 g |
| Tripotassium phosphate, dodecahydrate | 27 g |
| Potassium phosphate | 20 g |
| 5-Methylbenzotriazole | 250 mg |
| 2-Mercaptobenzothiazole | 23 mg |
| Benzotriazole | 83 mg |
| Hydroquinone | 29 g |
| Diisopropylaminoethanol | 2.3 ml |
| Amino compound Am-1 | 0.5 ml |
| Compound of Formula [I] | 7 g |
| Potassium hydroxide | for adjusting pH to 11.6 |
| Water to make one liter | |

TABLE 13

| Experiment No. | Light-sensitive material No. | Hydrazine derivative | Compound of Formula [I] in developer solution | Storage I Gamma value | Storage I Black spots | Storage II Gamma value | Storage II Black spots |
|---|---|---|---|---|---|---|---|
| 10-1 (Inv.) | (45) | H-44 | m-1 | 11.5 | 4.5 | 10.5 | 4 |
| 10-2 (Inv.) | (46) | H-46 | m-1 | 11.5 | 4.5 | 10.0 | 4.5 |
| 10-3 (Inv.) | (47) | H'-1 | m-1 | 11.0 | 3.5 | 9.0 | 3 |
| 10-4 (Comp.) | (48) | H-44 | — | 10.0 | 3 | 8.0 | 2 |
| 10-5 (Comp.) | (49) | H-46 | — | 10.5 | 3 | 7.5 | 2 |
| 10-6 (Comp.) | (50) | H'-1 | — | 10.0 | 3 | 6.0 | 2 |

As is apparent from Table 13, the processing of the hydrazine derivative-containing silver halide light-sensitive material in the cyclodextrin-containing developer solution makes it possible to markedly restrain the light-sensitive material's contrast deterioration and black spots occurring with time.

What is claimed is:

1. A silver halide photographic light-sensitive material comprising a support, a silver halide photographic emulsion layer and a protective layer, wherein at least one layer of said emulsion layer and said protective layer contains a cyclodextrin compound and a compound represented by the following formula (T) or a hydrazine compound selected from the group consisting of the following formulae H-a, H-b, H-c and H-d:

formula (T)

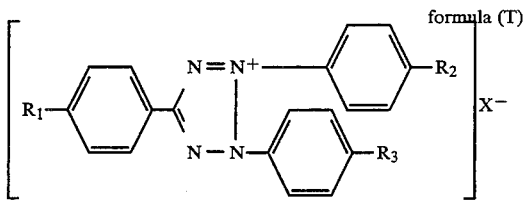

wherein $R_1$, $R_2$, and $R_3$ each represent a hydrogen atom or a substituent; and X represents an anion; formula H-a

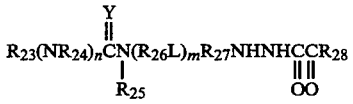

formula H-a wherein $R_{23}$ and $R_4$ each represent a hydrogen atom, an alkyl group, a phenyl group, a naphthyl group, a cyclohexyl group, a pyridyl group, or a pyrrolidyl group; $R_{25}$ represents a hydrogen atom, a benzyl group, an alkyl group or an alkoxy; Y is a sulfur atom or an oxygen atom; $R_{26}$ and $R_{27}$ each represent a divalent aromatic group; L represents a divalent linkage group; $R_{28}$ is —NR'R" or —$OR_{29}$, wherein R', R" and $R_{29}$ each are a hydrogen atom, an alkyl group, a phenyl group, a naphthyl group, or a heterocyclic group, provided that R' and R" may combine together with a nitrogen atom to form a ring; and m and n each are an integer of 0 or 1;

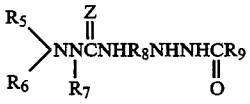

formula H-b wherein $R_5$, $R_6$ and $R_7$ each represent a hydrogen atom, an alkyl group, a phenyl group, a naphthyl group, a cyclohexyl group, a pyridyl group, a pyrrolidyl group, an alkoxy group or an aryloxy group; Z is a sulfur atom or an oxygen atom; $R_9$ represents an alkyl group, an alkoxy or an amino group, they may have a substituent of an alkoxy, cyano or aryl group; and $R_8$ represents a divalent aromatic group;

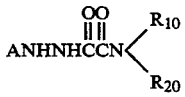

formula H-c

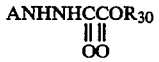

formula H-d wherein A represents an aryl group or a heterocyclic group containing a sulfur atom or an oxygen atom; $R_{10}$ and $R_{20}$ each represent a hydrogen atom, an alkyl group, an alkenyl group, an alkynyl group, an aryl group, a heterocyclic group, an alkoxy group, an alkenyloxy group, an alkynyloxy group, an aryloxy group, a hydroxy group or a heterocyclicoxy group, provided that either one of $R_{10}$ and $R_{20}$ represents an alkenyl group, an alkynyl group, a saturated heterocyclic group, an alkoxy group, an alkenyloxy group, an alkynyloxy group, an aryloxy group, a hydroxy group or a heterocyclicoxy group; $R_{30}$ represents an alkynyl group or a saturated heterocyclic group, and H in —NHNH— of formulae H-c and H-d may be substituted by a substituent.

2. The material of claim 1, wherein said cyclodextrin compound is selected from the group consisting of cyclodextrin, a cyclodextrin derivative, a branched cyclodextrin and a cyclodextrin polymer.

3. The material of claim 2, wherein said cyclodextrin is represented by the following formula (I):

formula (I)

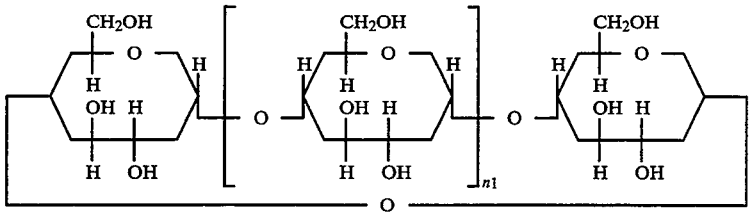

wherein $n_1$ represents an integer of 4 to 10.

4. The material of claim 3, wherein said $n_1$ represents 4, 5 or 6.

5. The material of claim 2, wherein said cyclodextrin is a clathrate compound of a cyclodextrin.

6. The material of claim 1, wherein at least one layer of said emulsion layer and said protective layer further contains a compound represented by the following formula (III), (IV), or (V):

formula (III)

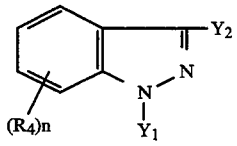

formula (IV)

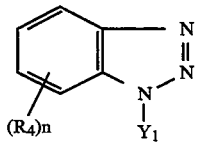

formula (V)

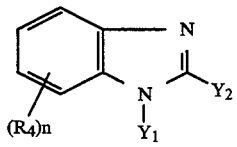

wherein $Y_1$ represents a hydrogen atom, a mercapto group or an alkali metal; $R_4$ and $Y_2$ each represent a hydrogen atom, a halogen atom, a nitro group, an amino group, a cyano group, a hydroxy group, a mercapto group, a sulfo group, an alkyl group, an alkenyl group, an alkinyl group, an alkoxy group, hydroxycarbonyl group, an alkylcarbonyl group or an alkoxycarbonyl group, and n represents an integer of 1 to 4.

7. The material of claim 1, wherein the amount of said cyclodextrin is 0.1 to 8 g/m$^2$.

8. The material of claim 1, wherein at least one layer of said emulsion layer and said protective layer contains said cyclodextrin compound and said hydrazine compound selected from the group consisting of said formulae H-a, H-b, H-c and H-d.

9. The material of claim 8, wherein said hydrazine compound is said formula H-c or H-d.

10. A method for processing a silver halide photographic light-sensitive material comprising a support and provided thereon, a silver halide photographic emulsion layer and a protective layer in that order, wherein at least one layer of said emulsion layer and said protective layer contains a cyclodextrin compound and said silver halide photographic emulsion layer contains a hydrazine derivative or a compound represented by the following formula (T), comprising the steps of:

exposing said material, and developing the exposed material with a developer in the presence of a cyclodextrin compound, formula (T)

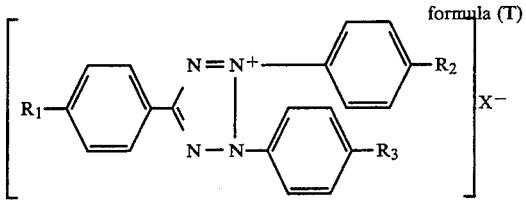

wherein $R_1$, $R_2$, and $R_3$ each represent a hydrogen atom or a substituent; and X represents an anion.

11. The process of claim 10, wherein said developing is conducted using a developer containing a cyclodextrin compound.

12. The process of claim 10, wherein said developing is conducted using a developer containing a cyclodextrin compound, and a compound represented by the following formula (III), (IV) or (V);

formula (III)

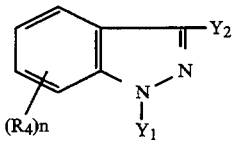

formula (IV)

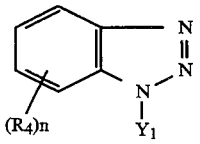

formula (V)

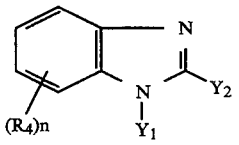

wherein $Y_1$ represents a hydrogen atom, a mercapto group or an alkali metal; $R_4$ and $Y_2$ each represent a hydrogen atom, a halogen atom, a nitro group, an amino group, a cyano group, a hydroxy group, a mercapto group, a sulfo group, an alkyl group, an alkenyl group, an alkinyl group, an alkoxy group, hydroxycarbonyl group, an alkylcarbonyl group or an alkoxycarbonyl group, and n represents an integer of 1 to 4.

13. The method of claim 10, wherein the amount of said cyclodextrin in said developer is 0.1 to 100 g/liter.

14. The method of claim 13, wherein the amount of said cyclodextrin in said developer is 0.5 to 50 g/liter.

15. The process of claim 10, wherein said hydrazine compound is selected from the group consisting of the following formulae H-a, H-b, H-c and H-d.

formula H-a

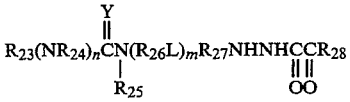

wherein $R_{23}$ and $R_{24}$ each represent a hydrogen atom, an alkyl group, a phenyl group, a naphthyl group, a cyclohexyl group, a pyridyl group, or a pyrrolidyl group; $R_{25}$ represents a hydrogen atom, a benzyl group, an alkyl group or an alkoxy; Y is a sulfur atom or an oxygen atom; $R_{26}$ and $R_{27}$ each represent a divalent aromatic group; L represents a divalent linkage group; $R_{28}$ is —NR'R" or —$OR_{29}$, wherein R', R" and $R_{29}$ each are a hydrogen atom, an alkyl group, a phenyl group, a naphthyl group, or a heterocyclic group, provided that R' and R" may combine together with nitrogen atom to form a ring; and m and n each are an integer of 0 or 1;

formula H-b

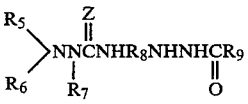

wherein $R_5$, $R_6$ and $R_7$ each represent a hydrogen atom, an alkyl group, a phenyl group, a naphthyl group, a cyclohexyl group: a pyridyl group, a pyrrolidyl group, an alkoxy group or an aryloxy group; Z is a sulfur atom or an oxygen atom; $R_9$ represents an alkyl group, an alkoxy or an amino group, they may have a substituent of an alkoxy, cyano or aryl group; and $R_8$ represents a divalent aromatic group;

formula H-c

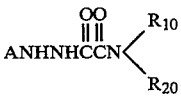

formula H-d

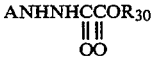

wherein A represents an aryl group or a heterocyclic group containing a sulfur atom or an oxygen atom; $R_{10}$ and $R_{20}$ each represent a hydrogen atom, an alkyl group, an alkenyl group, an alkynyl group, an aryl group, a heterocyclic group, an alkoxy group, an alkenyloxy group, an alkynyloxy group, an aryloxy group, a hydroxy group or a heterocyclicoxy group, provided that either one of $R_{10}$ and $R_{20}$ represents an alkenyl group, an alkynyl group, a saturated heterocyclic group, an alkoxy group, an alkenyloxy group, an alkynyloxy group, at aryloxy group, a hydroxy group or a heterocyclicoxy group; $R_{30}$ represents an alkynyl group or a saturated heterocyclic group, and H in —NHNH— of formulae H-c and H-d may be substituted by a substituent.

* * * * *